US005248860A

United States Patent [19]

Sirag, Jr.

[11] Patent Number: 5,248,860

[45] Date of Patent: Sep. 28, 1993

[54] USING FUZZY LOGIC TO DETERMINE ELEVATOR CAR ASSIGNMENT UTILITY

[75] Inventor: David J. Sirag, Jr., South Windsor, Conn.

[73] Assignee: Otis Elevator Company, Farmington, Conn.

[21] Appl. No.: 879,530

[22] Filed: May 4, 1992

Related U.S. Application Data

[63] Continuation of Ser. No. 693,178, Apr. 29, 1991, abandoned.

[51] Int. Cl.[5] ..... B66B 1/18

[52] U.S. Cl. ..... 181/127; 187/124; 187/125

[58] Field of Search ..... 187/124, 127, 131, 130, 187/135, 121

[56] References Cited

U.S. PATENT DOCUMENTS

| | | | |
|---|---|---|---|
| 4,411,337 | 10/1983 | Schröder et al. | 187/29 |
| 4,458,787 | 7/1984 | Uetani | 187/29 |
| 4,553,639 | 11/1985 | Uetani | 187/29 |
| 4,760,896 | 8/1988 | Yamaguchi | 187/124 |
| 4,947,965 | 8/1990 | Kuzunuki et al. | 187/127 |
| 4,984,174 | 1/1991 | Yasunobu et al. | 364/513 |
| 5,012,430 | 4/1991 | Sakurai | 364/513 |
| 5,022,498 | 6/1991 | Sasaki et al. | 187/127 |

FOREIGN PATENT DOCUMENTS 2115578 12/1981 United Kingdom .

*Primary Examiner*—R. Skudy
*Assistant Examiner*—Robert Nappi

[57] ABSTRACT

The utility of assigning each car of an elevator system to service a hall call is determined by estimating the performance of each elevator car using a plurality of performance criteria. The performance criteria are then scaled by values indicative of the customer preferences for elevator system performance in order to form a plurality of scaled performance fuzzy sets. An assignment utility fuzzy set is formed from terms of the scaled performance fuzzy sets. The utility of assigning each car to service a particular hall call is then set equal to the maximum value of the degrees of membership of all of the terms of the scaled performance fuzzy sets. Alternatively, the utility of assigning each car to service a particular hall call can be set equal to the minimum value of the degrees of membership of all of the terms of the scaled performance fuzzy sets.

2 Claims, 12 Drawing Sheets

BEGIN
120
122
OLDPC = 0
NEWPC = 0
124
W = 0
126
CALCULATE NEWPC
128
YES
NEWPC=OLDPC ?
NO
130
ADD W, OLDPC TO TABLE
132
OLDPC= NEWPC
134
W=W + WINC
136
W > WMAX ?
YES
137
ADD W, OLDPC TO TABLE
NO
DONE

USING FUZZY LOGIC TO DETERMINE ELEVATOR CAR ASSIGNMENT UTILITY

This is a continuation of application Ser. No. 07/693,178, filed Apr. 29, 1991, now abandoned.

TECHNICAL FIELD

This invention relates to the field of elevators and more particularly to the field of elevator control software.

BACKGROUND ART

It is desirable to assign elevator cars to service hall calls in a manner which maximizes the performance of the entire elevator system. This involves using a number of sophisticated algorithms which determine the number of passengers in the elevator cars, determine the traffic mode of the elevator system, estimate the number of hall passengers at each stop, and calculate the tradeoffs between different performance parameters. These algorithms can be implemented as a plurality of fixed rules.

However, difficulties occur at the boundary conditions for the fixed rules. For example, a rule which bases the system traffic mode determination partially on the time of day might be: "if it is between 7:00 AM and 9:00 AM and if <other conditions>, then set the system traffic mode to UP-PEAK". The difficulty with such a rule is that at 6:59 AM, all of the other conditions which cause the system traffic mode to be UP-PEAK may already be present, but because of the fixed rule, the system cannot be deemed to be in the UP-PEAK traffic mode. The operation of the system may change abruptly depending on the traffic mode, but the input conditions, the predominate traffic patterns, probably change gradually between 6:59 AM and 7:00 AM.

Similar problems exist for all of the other car assignment related algorithms. Generally, the input conditions change gradually and, for the most part, continuously while the response to those changes, i.e. the reactions of the system (and ultimately the assignment of an elevator car to a hall call), change abruptly and discontinuously as the inputs to the system transition through boundary conditions.

DISCLOSURE OF INVENTION

Objects of the invention include determining the assignment utility for elevator cars in an elevator system.

According to the present invention, the utility (suitability) of assigning each elevator car to service a hall call is determined by first estimating the performance of each car for each of a plurality of performance criteria, scaling the estimated performances by values indicative of the assigned importance of each performance criteria, and setting the utility equal to the maximum value from the scaled performance values.

The foregoing and other objects, features and advantages of the present invention will become more apparent in light of the following detailed description of exemplary embodiments thereof, as illustrated in the accompanying drawings.

BEST MODE FOR CARRYING OUT THE INVENTION

Figure 1:
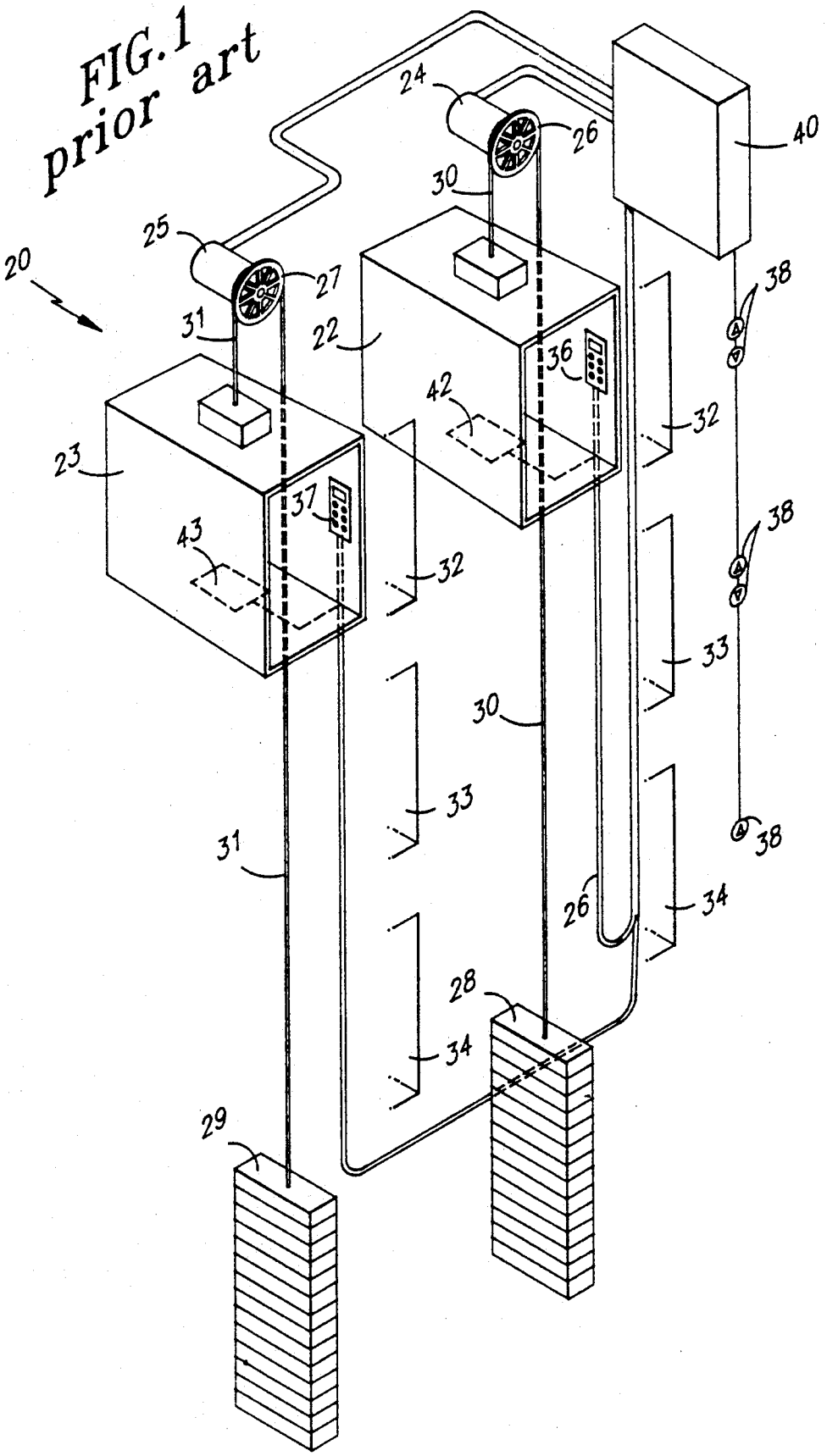
FIG. 1 prior art
FIG. 1 is a perspective, partially broken away, view of an elevator system which may employ the present invention.

Referring to FIG. 1, an elevator system 20 is comprised of a first elevator car 22, a second elevator car 23, a first motor 24 having a pulley 26 attached thereto, a second motor 25 having a pulley 27 attached thereto and counterweights 28, 29. A first cable 30 is threaded through the pulley 26 and attached at one end to the first car 22 and at the other end to the counterweight 28. A second cable 31 is threaded through the pulley 27 and attached at one end to the second car 23 and at the other end to the counterweight 29.

The first motor 24 rotates to move the first elevator car 22 between a plurality of building floors 32–34 in response to activation of one or more car call buttons 36 by a car passenger (i.e., a passenger riding in the car 22). The second motor 25 rotates to move the second elevator car 23 between the building floors 32–34 in response to activation of one or more car call buttons 37 by a car passenger. The motors 24, 25 also rotate to move the elevator cars 22, 23 between floors in response to one or more hall calls. A hall call is an event which occurs when one or more hall call buttons 38 is pressed by a hall passenger. A hall passenger is a prospective user of the elevator system 20 waiting in a hallway at one of the floors 32–34 for service by one of the cars 22, 23.

An electronic elevator controller 40 for the elevator system 20 receives electronic input signals from the car call buttons 36, 37, the hall call buttons 38, from a first weight sensor 42, located in the floor of the first car 22 and from a second weight sensor 43, located in the floor of the second car 23. The weight sensors 42, 43 each provide an electronic signal which varies according to the weight of the passengers in the cars 22, 23, respectively. The controller 40 provides an output signal to the first motor 24 for moving the first car 22 between the various floors 30–32. The controller 40 also provides an output signal to the second motor 25 for moving the second car 23 between the various floors 30–32.

The electronic hardware for the controller 40 is a conventional microprocessor system, the implementation of which is known to those skilled in the art, containing a microprocessor (not shown), one or more ROMs (not shown) for storing elevator controller software, one or more RAMs (not shown), means for providing the output signals (not shown) to the motors 24, 25, and means for receiving the input signals (not shown) from the car call buttons 36, 37, the hall call buttons 38, and from the weight sensors 42, 43.

Figure 2:
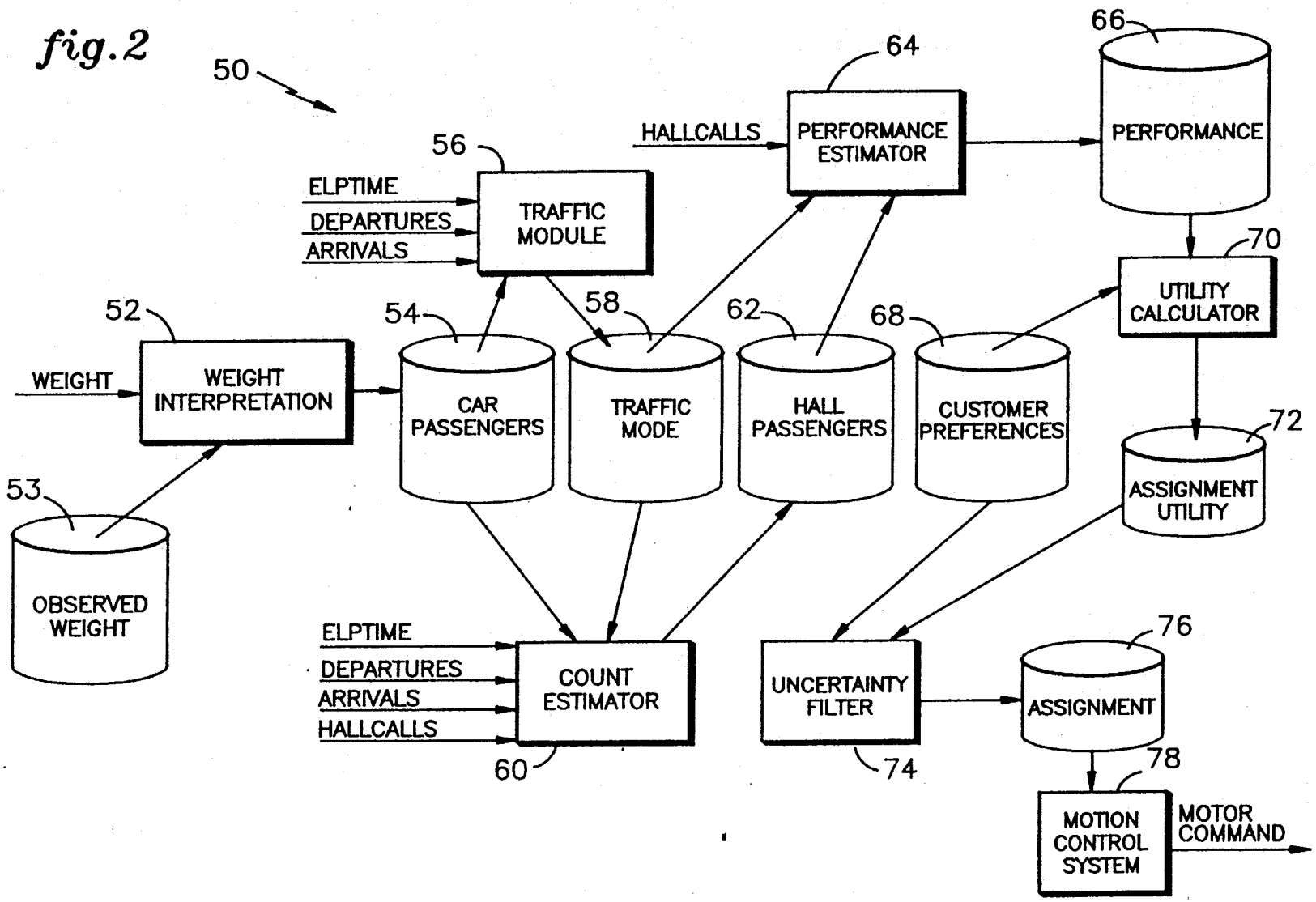
FIG. 2 is a dataflow diagram that illustrates operation of elevator control software, according to the present invention.

Referring to FIG. 2, a dataflow diagram 50 illustrates operation of elevator control software which is stored in the ROMs and which is executed by the microprocessor. The software causes the controller 40 to provide the output signals to direct operation of the motors 24, 25 in response to input electronic signals to the controller 40. Boxes on the diagram 50 indicate program modules (portions of the elevator control software) while cylinders indicate data elements (portions of elevator control data). Arrows between boxes and cylinders indicate the direction of the flow of data. Unlike a flowchart, no portion of the dataflow diagram 50 indicates any temporal relationships between the various modules. The input signals shown on the diagram 50 are summarized in the following table:

| Signal Name | Description |
|---|---|
| WEIGHT | Indicates passenger weight |
| ELPTIME | Elapsed time counter |
| DEPARTURES | Indicates departures of cars from various floors |
| ARRIVALS | Indicates arrivals of cars at various floors |
| HALLCALLS | Indicates hall calls made from various floors |

A more detailed description of each of the above signals is contained throughout the remainder of this document.

A weight interpretation module 52 is provided with a WEIGHT signal from each of the weight sensors 42, 43 and with input data from an observed weight data element 53. The weight interpretation module 52 uses the WEIGHT signals and the observed weight data element 53 to estimate the number of car passenger as cars leave the various floors. The passenger estimate is provided by the weight interpretation module 52 to a car passengers data element 54. Using the observed weight data element 53 and the WEIGHT signals from the weight sensors 42, 43 to estimate the number of car passengers is discussed in more detail with respect to FIG. 4, hereinafter.

The car passengers data element 54 is provided as an input to a traffic module 56, which is also provided with input from an ELPTIME input signal, a DEPARTURES input signal, and an ARRIVALS input signal. The ELPTIME signal is indicative of elapsed time (i.e a counter which increments at a fixed rate). The DEPARTURES signal indicates the departure of the elevator cars 22, 23 from the various floors 32–34. The ARRIVALS signal indicates the arrival of the cars 22, 23 at each of the floors 32–34.

There are three mode variables used by the elevator control software: UP-PEAK, DOWN-PEAK, and OFF-PEAK. The magnitude of UP-PEAK is indicative of the extent to which passengers are riding from the lobby to higher floors. The magnitude of DOWN-PEAK is indicative of the extent to which passengers are riding from higher floors to the lobby. The magnitude of OFF-PEAK is indicative of the extent to which passengers are riding between non-lobby floors. The values of UP-PEAK, DOWN-PEAK, and OFF-PEAK are stored by the traffic module 56 into a traffic mode data element 58. Operation of the traffic module 56 is described in more detail with respect to FIG. 6, hereinafter.

The ELPTIME, DEPARTURES, and ARRIVALS signals are provided as inputs to a count estimator module 60. A HALLCALLS signal, which indicates that any of the hall call buttons 38 has been pressed, is also provided as an input to the count estimator module 60. The count estimator module 60 is also provided with input from the car passengers data element 54 and from the traffic mode data element 58. The count estimator module 60 estimates the number of hall passengers at a particular stop (a particular floor for service in a particular direction) waiting for service by an elevator car. Every floor, except the top and bottom floors, has two stops, an up stop and a down stop. The top floor has only a single down stop and the bottom floor has only a single up stop. The count estimator module 60 outputs the estimate to a hall passengers data element 62. Operation of the count estimator module 60 is described in more detail hereinafter.

A performance estimator module 64 is provided with input from the HALLCALLS signal and from the traffic mode and the hall passengers data elements 58, 62. The performance estimator module 64 predicts the performance of each of the cars 22, 23 in response to a particular hall call. Output from the performance estimator module 64 is provided to a performance data element 66. Operation of the performance estimator module 64 is described in more detail hereinafter.

The performance data element 66 and a customer preferences data element 68 are provided as inputs to an assignment utility calculator module 70, which determines the utility of assigning each of the cars 22, 23 to respond to a particular hall call by predicting the performance of each of the cars 22, 23 and scaling the predicted performance based on the customer preferences. Output from the assignment utility calculator module 70 is provided to an assignment utility data element 72. Operation of the assignment utility calculator module 70 is described in more detail hereinafter.

The assignment utility and customer preferences data elements 68, 72 are provided as inputs to an uncertainty filter module 74, which assigns a particular car to service a particular hall call using the preliminary assignment data of the assignment utility data element 72. The assignment is made only when the uncertainty associated with assignment of one of the cars is below a predetermined threshold indicated by data stored in the customer preferences data element 68. In situations where it is acceptable to wait until the last possible moment to assign a car to a hall call, the uncertainty filter module 74 does not provide data to an assignment data element 76 until the uncertainty associated with the assignment utility data element 72 is fairly low. In situations where a car assignment must be made relatively quickly after a hall call, the uncertainty filter module 74 provides data to the assignment data element 76 even though the uncertainty associated with the assignment is relatively high. Operation of the uncertainty filter module 74 is described in more detail hereinafter.

The assignment data element 76 is provided as an input to a motion control system module 78, which provides the signals to the motors 24, 25 to move the elevator cars 22, 23. The motion control system module 78 uses the information from the assignment data element 76 to cause the assigned one of the elevator cars 22, 23 to stop at a particular one of the floors 32–34 in response to a hall call. There are many types of generic elevator software motion control systems which are known to those skilled in the art and are currently in use. Many of the generic motion control systems would be suitable implementing the motion control system module 78.

The weight interpretation module 52 transforms the WEIGHT signal from each of the weight sensors 42, 43, one at a time, into an estimate of the number of car passengers by using fuzzy logic, a branch of mathematics closely related to basic set theory and logic. Fuzzy logic involves using sets having basis elements which are only partially contained in the sets. For example, whereas a traditional set C may be defined as {X, Y, Z}, a fuzzy set F can be defined as {0.3|X, 0.7|Y, 0.1|Z} wherein the numbers which precede the vertical bars indicate the degree of membership of basis elements X, Y, and Z. The quantity 0.3|X is called a term of the fuzzy set. The basis elements X, Y, and Z can represent numeric or non-numeric quantities. In cases where the basis elements X, Y, and Z represent numbers, the basis element, or the value of a term, is simply the numerical quantity represented by X, Y, or Z. A crisp value is any value or system of values which does not employ fuzzy logic. A thorough discussion of fuzzy logic can be found in Schmucker, K. J., *Fuzzy Sets, Natural Language Computations, and Risk Analysis,* Computer Science Press, Rockville Md., 1984.

Although the discussion hereinafter explains implementation details of operation of the fuzzy system, much of the implementation can be automated by tools which translate high level fuzzy logic statements into compilable computer code. One such development tool is the Togai Fuzzy C Development System, manufactured by Togai InfraLogic Inc., of Irvine Calif., which converts fuzzy logic statements into compilable C code.

The observed weight data element 53 shown in FIG. 2 is constructed by having an observer tabulate the number of passengers in the elevator cars 22, 23 vs. the magnitude of the WEIGHT signals provided by the weight sensors 42, 43. Ideally, this tabulation is performed at the building where the elevator system 20 is installed in order to have the data account for passenger loading and passenger weight distributions for the particular building. However, it is possible to construct the observed weight data element using generic tables showing probabilities and distributions of people's weights. The tabulated data is used to construct a plurality of fuzzy sets which are stored in the observed weight data element 53. Each of the fuzzy sets corresponds to a particular passenger count. For each set, the degrees of membership of each of the terms correspond to the number of times a particular magnitude of the WEIGHT signal has been observed with that number of passengers in the car, and the basis elements correspond to particular weights. Each of the sets can be represented as FO(N) where N is a particular passenger count and each element within that set can be represented as FO(M, W) where W is a particular weight, and M=number of occurences: $FO(N)=\{M_1|W_1, M_2|W_2, \ldots M_jW_j\}$.

Figure 3:
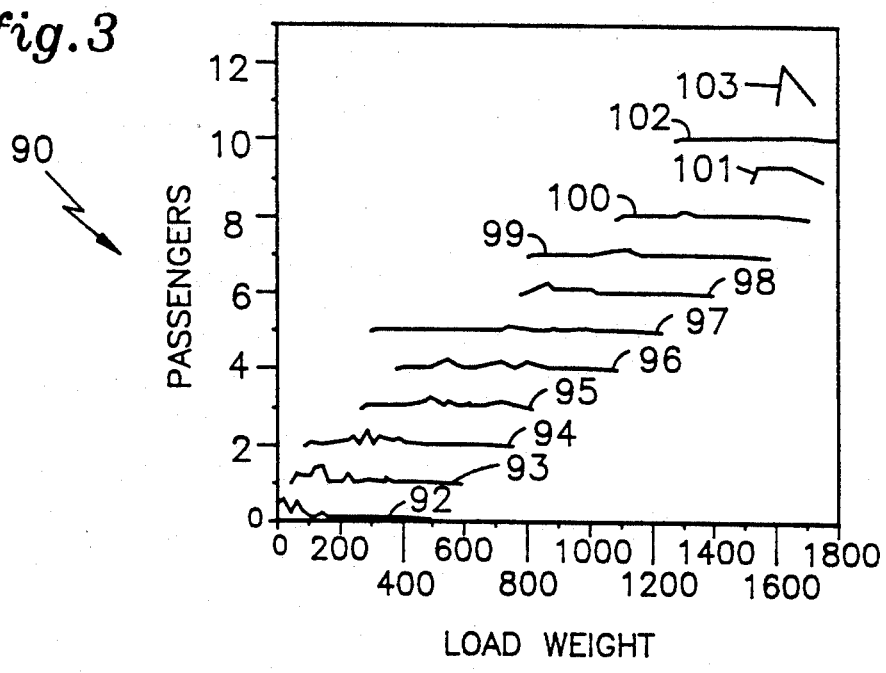
FIG. 3 is a graph illustrating empirically observed elevator weight loading data, according the present invention.

FIG. 3 is a graph 90 illustrating a hypothetical group of histograms of fuzzy sets constructed by tabulating passenger loading (counts) vs. the magnitude of the WEIGHT signal. The graph 90 is comprised of a plurality of plots 92–103 wherein the plot 93 corresponds to the fuzzy set describing the different values of the WEIGHT signal for one passenger, i.e. FO(1), the plot 94 corresponds to the fuzzy set describing the different values of the WEIGHT signal for two passengers, FO(2), etc. The relative magnitudes of the plots 92–103 indicate the number of times a particular magnitude of the WEIGHT signal is observed and hence indicate the degree of membership of the terms of the fuzzy sets. In fact, each plot has an abscissa of weight and an ordinate (not marked) of some normalized, dimensionless value, such as zero to one, which represent the relative likelihood that such number of passengers provide a weight signal of so many pounds. In a sense then, FIG. 3 is a table of twelve graphs, one per set, for sets relating to 0–11 passengers.

Figure 4:
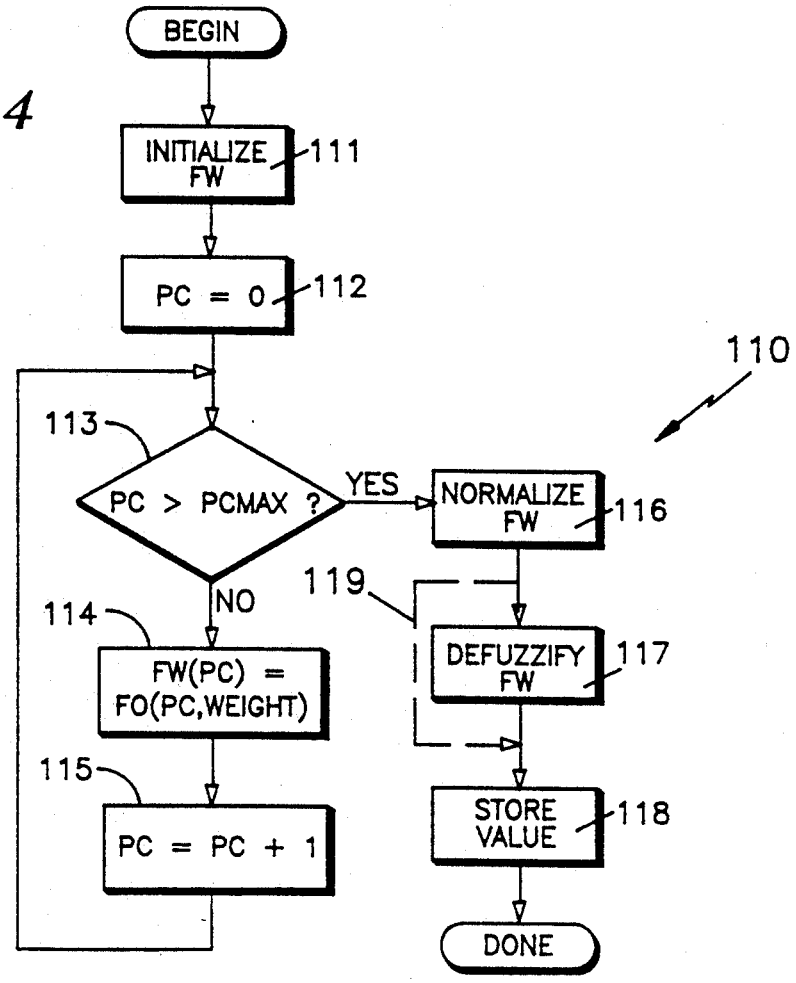
FIG. 4 is a flowchart illustrating operation of a weight interpretation software module, according to the present invention.

FIG. 4 is a flowchart 110 illustrating some of the operation of the weight interpretation module 52. Processing begins at a first step 111 where a fuzzy set FW(PC) (P representing a particular passenger count) is initialized to have no terms. Following the step 111 is a step 112 where a variable representing hypothetical passenger counts, PC, is initialized to zero. Following the step 112 is a test step 113 where the value of the variable PC is compared to PCMAX, a predetermined constant value equal to the maximum number of possible car passengers (shown, in the example of FIG. 3).

If PC is not greater than PCMAX, control passes from the test step 113 to a step 114 where a term, taken from the fuzzy set FO(PC) stored in the observed weight data element 53, is added to the fuzzy set FW. The added term corresponds to a passenger count equal to PC and a weight equal to the magnitude of the current WEIGHT signal: the added term is membership of the FO(PC, WEIGHT) term (a magnitude of 0–1 in FIG. 3). After the step 114 is a step 115 where the PC variable is incremented.

The steps 113–115 are repeatedly executed to develop a set, which for 600 pounds might be {0|0, 0.1|1, 0.2|2, 0.3|3, 0.7|4, 0.4|5, 0|6, etc.} for the example of FIG. 3. When PC exceeds PCMAX at the test step 113, control passes from the step 113 to a step 116, where the fuzzy set FW is normalized. Normalization of a fuzzy set involves dividing all of the degrees of membership of the terms by a constant value in order to make the sum of all the degrees of membership equal to one (the example: {0.00|0, 0.06|1, 0.12|2, 0.18|3, 0.41|4, 0.24|5, 0|6, etc.}).

After the step 116 is a step 117 where the fuzzy set FW is defuzzified to produce a value equal to the passenger count. Defuzzification is a process whereby a fuzzy logic set is reduced to a crisp, i.e. single, value. FW can be defuzzified by using the value (the basis element, in this case a number of passengers) of the term having the highest degree of membership (in the example, =4). FW can also be defuzzified by summing the products of the degree (normalized) of membership of each term and the passenger count represented by each term (in the example, =3.6). After the step 117 is a 118 where the calculated value of the passenger count is stored in the passenger count data element 54 shown in FIG. 2, indexed by the weight for which the module 110 (FIG. 4) was run. The passenger count data element 54 is used by the traffic module 56 and the count estimator module 60, in a manner described in more detail hereinafter. If it is possible for the traffic module 56 and the count estimator module 60 to make use of the elevator passenger count for each weight measured expressed as a fuzzy logic set rather than as a crisp value, the weight interpretation module 52 does not defuzzify the set FW, but rather follows a logic path 119 around the defuzzification step 117 and stores the fuzzy set FW, at a series of passenger-indexed addresses for the particular weight rather than a crisp value, at the step 118.

The code illustrated by the flowchart 110 of FIG. 4 is meant to be run real time by the microprocessor of the elevator controller 40. If only a crisp value of elevator car passenger count is desired, however, then the code illustrated by the flowchart of FIG. 4 can be executed off-line to generate a weight interpretation table, which is a table of values of the magnitude of the WEIGHT signal vs. passenger counts, that can be indexed (accessed) by the weight interpretation module 52 at run time.

Figure 5:
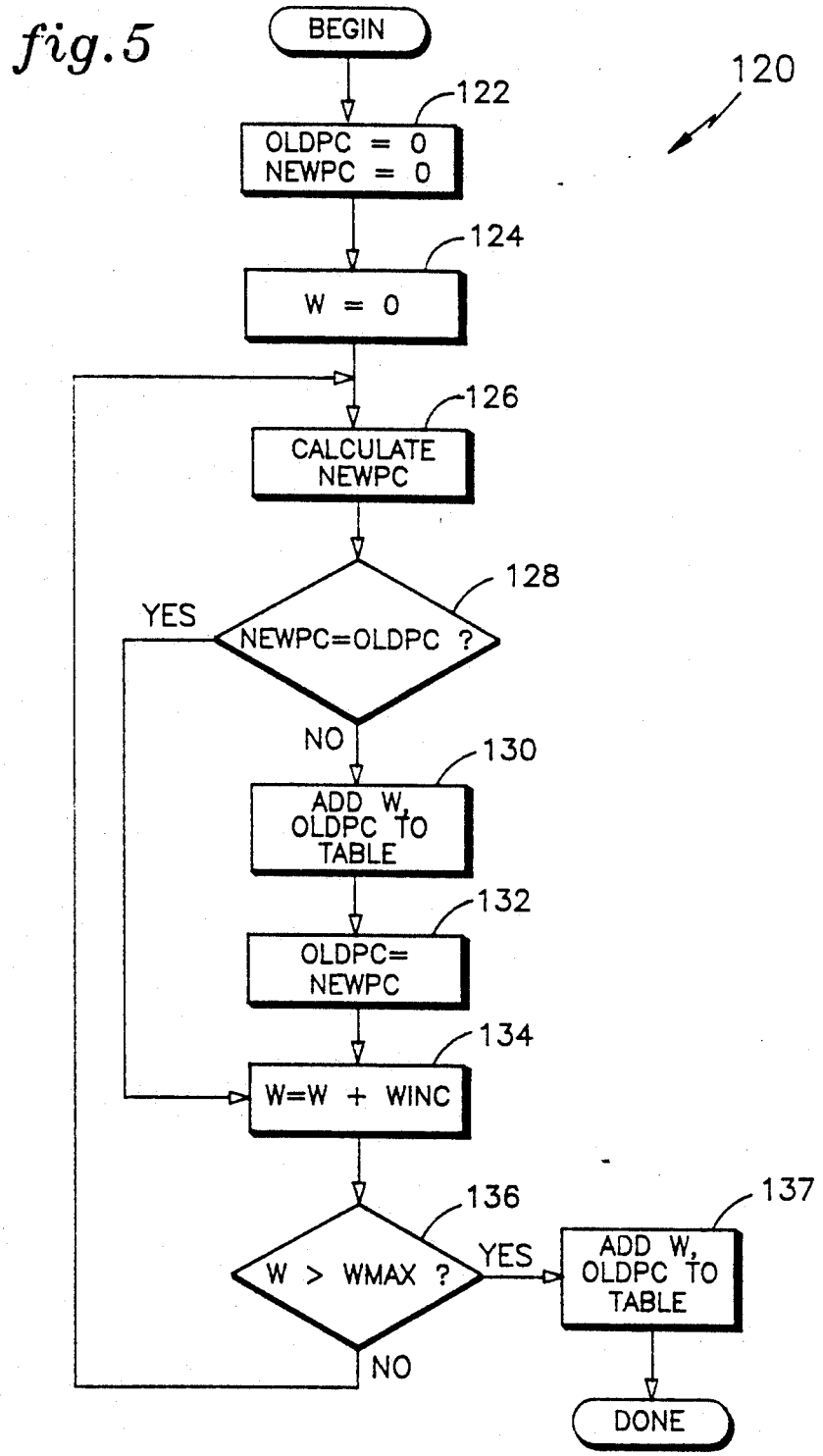
FIG. 5 is a flowchart 120 illustrating off-line construction of a weight interpretation table, according to the present invention.

FIG. 5 is a flowchart 120 illustrating off-line construction of a weight interpretation table which can be loaded into the ROMs of the elevator controller 40 and accessed by the weight interpretation module 52 to provide a crisp elevator car passenger count based upon the magnitude of the WEIGHT signal. The WEIGHT signal becomes the index to the table and the passenger count is the entry at that index. At a first step 122, two variables, used only in FIG. 5 OLDPC and NEWPC, are initialized to zero. Following the first step 122 is a step 124 where a third variable, W, is initialized to zero. After the step 124 is a step 126 (which is, in fact, the subroutine 110 of FIG. 4) where NEWPC is set equal to the passenger count that is calculated by the method illustrated by the flowchart 110 of FIG. 4, except that the value of W is used in place of the magnitude of the WEIGHT signal. After the step 126 is a test step 128 where the variable NEWPC is compared to the variable OLDPC. The reason for this is that only values of W, PC which differ are put into the table. If the variables are not equal, control passes from the step 128 to a step 130, where the values of OLDPC and W are entered into the weight interpretation table being constructed.

After the step 130 is a step 132 where the variable OLDPC is set equal to the variable NEWPC. In this fashion, each calculated value of PC is compared only with the last value of PC to be stored in the table with a related value of weight. The table thus created has indices which comprise only these values of W (analogous to the magnitude of the WEIGHT signal) which cause the entries to the table, the number of passengers, to change. At run time, the weight interpretation module 52 searches the table to find two adjacent indices wherein one is greater than the magnitude of the WEIGHT signal and the other is less than or equal to the magnitude of WEIGHT signal. The entry at the higher of the two table indices is the passenger count which is written to the passenger count data element 54.

Following the step 132 (or following the test step 128 if OLDPC equals NEWPC) is a step 134 where the variable W is increased by an amount WINC, a predetermined constant equal to the granularity of each of the weight sensors 42, 43 (i.e., the minimum difference between two weight measurements). After the step 134 is a test step 136, where W is compared to WMAX, a predetermined constant equal to the maximum possible magnitude for the WEIGHT signal, which may be 1600 or 1700 pounds in the example of FIG. 3. If W is not greater than WMAX, control passes from the step 136 back to the step 126. Otherwise, control passes to a step 137 where OLDPC and W are added as the last entries to the table, even though W is outside max, it provides the basis to reach a value of PC just below W. After the step 137, processing is complete.

The weight interpretation module 52 provides, to the car passengers data element 54, data indicative of the number of passengers in the elevator cars 22, 23. The car passengers data element 54, the ELPTIME signal, the DEPARTURES signal, and the ARRIVALS signal are provided as inputs to the traffic module 56, which determines the predominant usage pattern of the elevator system 20 and provides the result to the traffic mode data element 58. The traffic mode of the elevator system 20 can be described as up peak, indicating that most of the traffic is going from the lobby of the building to higher floors, down peak, indicating that most of the traffic is going from higher floors of the building to the lobby, or off peak, indicating that there is no discernable predominant traffic pattern.

Figure 6:
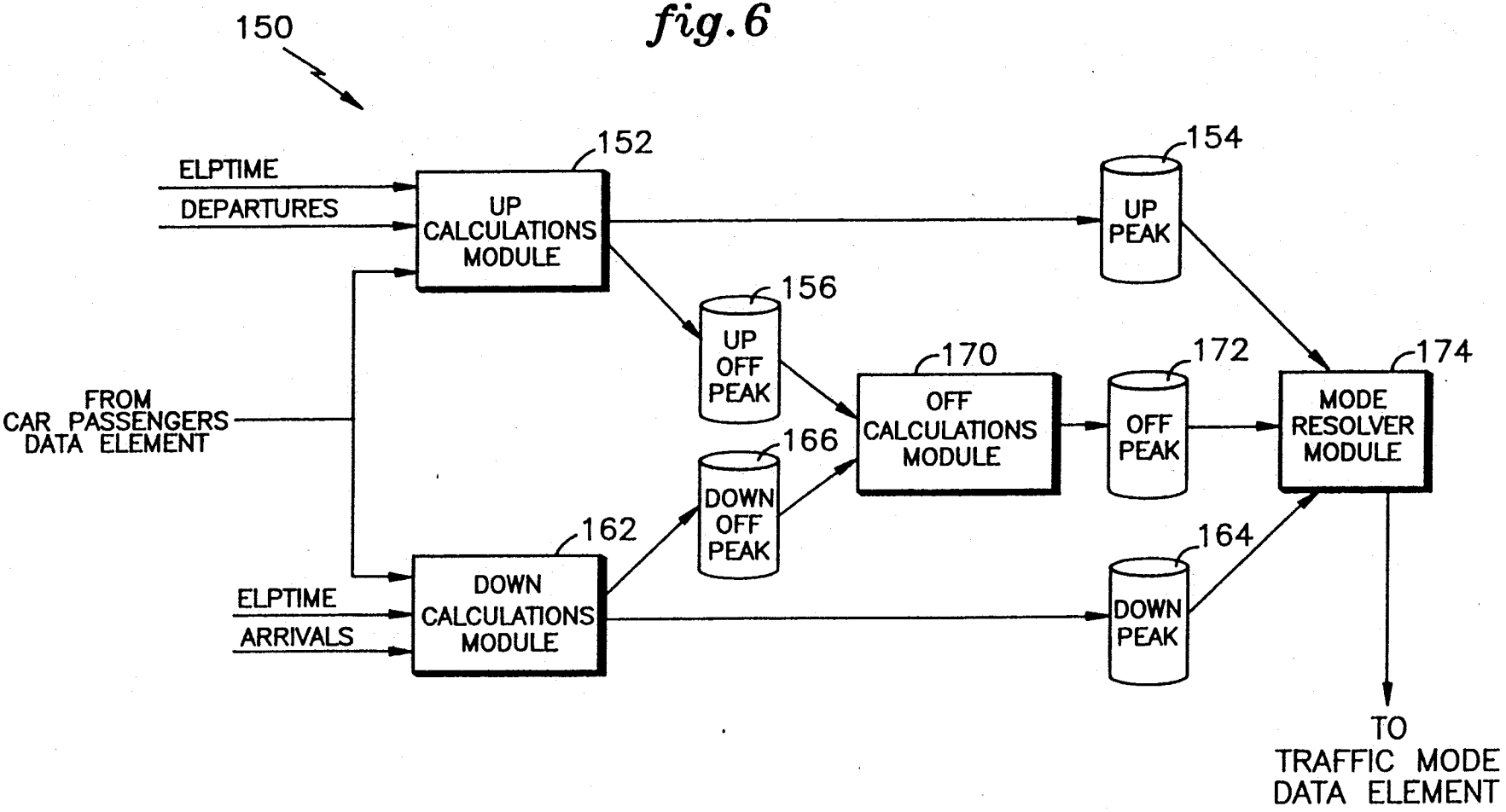
FIG. 6 is a dataflow diagram illustrating operation of a traffic module, according to the present invention.

Referring to FIG. 6, a dataflow diagram 150 illustrates operation of the traffic module 56. The ELPTIME and DEPARTURES signals and data from the car passengers data element 54 are provided as inputs to an up calculations module 152, which uses Up-PEAK-ONSET rules (described in more detail with respect to FIG. 7-10) hereinafter) to calculate a value for UP-PEAK variable, which is stored in an up peak data element 154. The up calculations module 152 also uses UP-PEAK-TERMINATION rules (described in more detail hereinafter) to determine a value for an UP-OFF-PEAK variable which is stored in an up off peak data element 156.

The ELPTIME and ARRIVALS signals and data from the car passengers data element 54 are provided as inputs to a down calculations module 62, which uses DOWN-PEAK-ONSET rules (described in more detail hereinafter) to calculate a value for the DOWN-PEAK variable, which is stored in a down peak data element 164. The down calculations module 162 also uses DOWN-PEAK-TERMINATION rules (described in more detail hereinafter) to determine a value for a DOWN-OFF-PEAK variable which is stored in a down off peak data element 66. The up off peak data element 156 and the down off peak data element 166 are provided as inputs to an off calculations module 170 which combines the data from the elements 156, 166 (in a manner described in more detail hereinafter) to calculate a value for the OFF-PEAK variable, which is stored in an off peak data element 172.

The UP-PEAK variable stored in the up peak data element 154, the DOWN-PEAK variable stored in the down peak data element 164, and the OFF-PEAK variable stored in the off peak data element 172 are provided as inputs to a mode resolver module 174, which combines the input data to provide a result to the traffic mode data element 58. The result can either be a single crisp value or a fuzzy set, depending upon the nature of follow on processes which use information from the traffic mode data element 58. A crisp value (i.e. a single indication of the mode) can be obtained by deeming the mode to be either up-peak, down-peak, or off-peak depending upon which of the UP-PEAK, DOWN-PEAK, or OFF-PEAK variables, respectively, is greatest.

The mode resolver module 174 can also provide a fuzzy set to indicate the traffic mode of the elevator system 20. The set would have a term corresponding to the UP-PEAK variable, a term corresponding to the DOWN-PEAK variable, and a term corresponding to the OFF-PEAK variable where the degree of membership of each of the terms would be proportional to the values of the UP-PEAK, DOWN-PEAK, and OFF-PEAK variables, respectively.

The UP-PEAK-ONSET rules used by the up calculations module 152 have the form:

```
if  (DPTURE-TIME-i is SHORT-PERIOD)
    and (i is SEVERAL-CARS)
    and (DPTING-ELEVATOR-1 is HEAVILY-LOADED)
    and (DPTING-ELEVATOR-2 is HEAVILY-LOADED)
    and . . .
    and (DPTING-ELEVATOR-i is HEAVILY-LOADED)
then set UP-PEAK
```

where ELEVATOR-CAR-1 is the elevator car which has most recently departed from the lobby, (e.g., the car that triggers evaluating the rules at this moment) ELEVATOR-CAR-2 is the second most recently departed elevator car and generally ELEVATOR-CAR-i is the with most recently departed elevator car. DPTURE-TIME-i is defined as the elapsed time since the departure of the ith most recently departed elevator car, and i is a number from one to N, the number of rules. The number of rules, N, is set about equal to the number of elevator cars in the dispatching group, to acquire a sense of a full dispatching cycle in the group. This number N is also the number of cars that have previously departed which are examined relative to the UP-PEAK-ONSET rules. However, N could be chosen to be either less than or greater than the number of cars.

The UP-PEAK-ONSET, UP-PEAK-TERMINATION, DOWN-PEAK-ONSET, and DOWN-PEAK-TERMINATION rules can be described generally as having the form:

if <condition> then set X-PEAK where X-PEAK is either UP-PEAK, DOWN-PEAK, UP-OFF-PEAK, or DOWN-OFF-PEAK.

For a fuzzy logic conditional expression, the value of the result variable (the variable following the "then" portion of the conditional expression) is set according to the value of the conditional portion. For the above equation, therefore, X-PEAK is set to a value which depends upon the value of the <condition>.

The conditional portion of the UP-PEAK-ONSET rule contains a plurality of simple expressions, such as (DPTURE-TIME-i is SHORT-PERIOD) and i is SEVERAL-CARS), which are connected by ANDs. The value of the conditional is the minimum value of the simple expressions. Evaluating the simple expressions requires quantifying SHORT-PERIOD, SEVERAL-CARS, and HEAVILY-LOADED.

Figure 8:
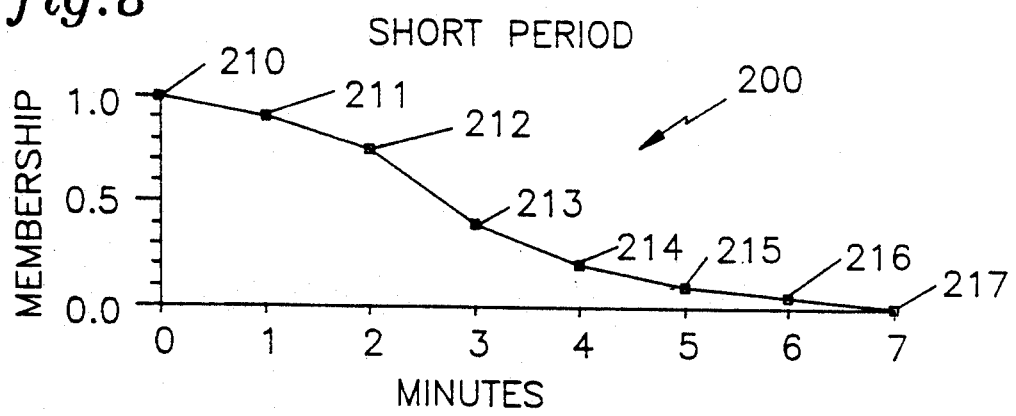
FIG. 8 is a graph illustrating a SHORT-PERIOD fuzzy logic set, according to the present invention.
Figure 9:
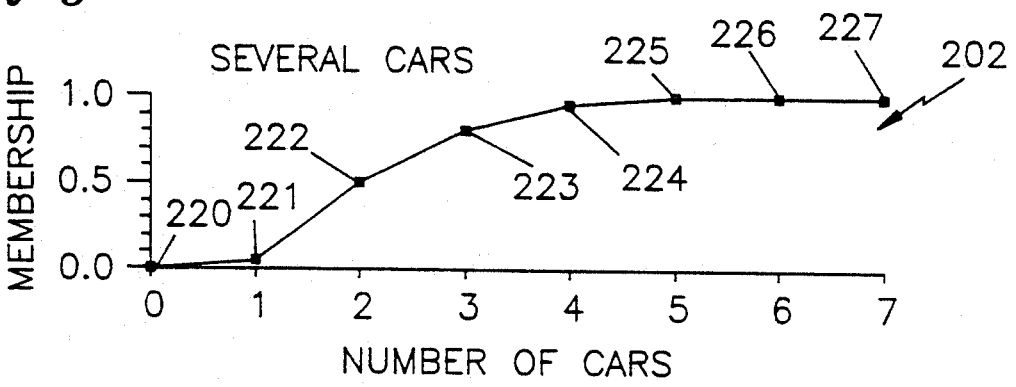
FIG. 9 is a graph illustrating a SEVERAL-CARS fuzzy logic set, according to the present invention.
Figure 10:
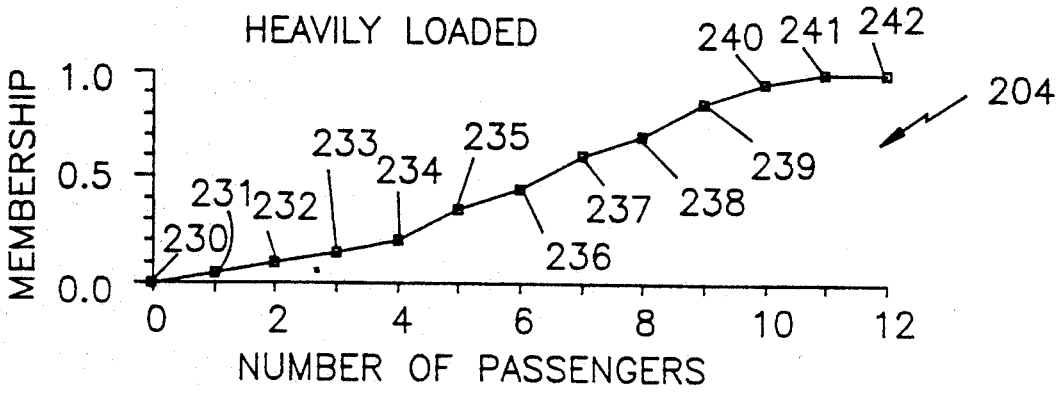
FIG. 10 is a graph illustrating a HEAVILY-LOADED fuzzy logic set, according to the present invention.

Referring to FIG. 8, FIG. 9, and FIG. 10 a first graph 200 illustrates a fuzzy set for representing SHORT-PERIOD, a second graph 202 illustrates a fuzzy set for representing SEVERAL-CARS, and a third graph 204 illustrates a fuzzyset for representing HEAVILY-LOADED. The SEVERAL-CARS graph 202 is for an elevator system having several cars. A graph for the two car elevator system 20 of FIG. 1 would make it more difficult to illustrate the SEVERAL-CARS fuzzy set.

The graph 200 has a plurality of squares 210–217 superimposed thereon wherein each of the squares 210–217 represents a term of the SHORT-PERIOD fuzzy set. This set can be considered to be the decimal fraction of a group of elevator experts that would respond "yes" to the question "do you think M is a short period?", where M is 0–7 minutes. It is an empirical assessment of the relationship between how often cars leave the lobby, along with how many and how loaded, and the need to use up-peak dispatching, based on historical observations or experience.

Similarly, the graph 202 has a plurality of squares 200–227 superimposed thereon for representing terms of the SEVERAL-CARS fuzzy set ("Do you think i is several car for up-peak purposes?"). The graph 204 has a plurality of terms 230–242 superimposed thereon for representing elements of the HEAVILY-LOADED fuzzy set ("Do you think PC is a heavy load for dispatching purposes?").

The vertical axes of the graphs 200, 202, 204 indicate the degree of membership for terms represented by the squares 210–217, 220–227, 230–242 and the horizontal axes of the graphs 200, 202, 204 represents the values of the basis elements. For example, the square 210 represents a term of the SHORT-PERIOD fuzzy set having a basis element value of zero minutes and a degree of membership of 1.0 and the square 213 represents a term of the SHORT-PERIOD fuzzy set having a basis element value of three minutes and a degree of membership of approximately 0.4.

Each of the simple expression for the UP-PEAK-ONSET rule is evaluated using the SHORT-PERIOD, SEVERAL-CARS, and HEAVILY-LOADED fuzzy sets. The value of the (DPTURE-TIME-i is SHORT-PERIOD) is the degree of membership of the term of the SHORT-PERIOD fuzzy set having a basis element equal to DPTURE-TIME-i. For example, if the value of DPTURE-TIME-i is five minutes, the expression (DPTURE-TIME-i is SHORT-PERIOD) equals the degree of membership of the term of the SHORT-PERIOD fuzzy set having basis element equal to five minutes, which is illustrated in the graph 200 by the square 215 (and has a value of 0.10).

The value of the (i is SEVERAL-CARS) expression is the degree of membership of the term of the SEVERAL-CARS fuzzy set having a basis element equal to i. For example, if i equals three (the car that left two cars before this one that triggered the rules), the expression (i is SEVERAL-CARS) equals the degree of membership of the term of the SEVERAL-CARS fuzzy set having a basis element equal to three, which is illustrated in the graph 202 by the square 223 (and has a value of 0.81).

Evaluation of the (DPTING-ELEVATOR-i is HEAVILY-LOADED) expression depends upon whether the number of passengers in elevator car i, which is an input value to the traffic module 56, is a crisp value or a fuzzy set. If the passenger count is a crisp value, the (DPTING-ELEVATOR-i is HEAVILY-LOADED) expression equals the degree of membership of a term of the HEAVILY-LOADED fuzzy set having a basis element value equal to the crisp passenger count as shown in FIG. 10.

If the number of passengers in elevator car is expressed as a fuzzy set (e.g., a vertical slice of the FIG. 3 histograms), the (DPTING-ELEVATOR-i is HEAVILY-LOADED) expression is evaluated by taking the maximum value of the degree of membership of the terms of a fuzzy set formed by the intersection of the passenger count fuzzy set (generated in FIG. 3) and the HEAVILY-LOADED fuzzy set (illustrated in FIG. 10). Generally, the fuzzy set formed by the intersection of two fuzzy sets is a fuzzy set having terms whose degree of membership equals the minimum degree of membership of corresponding terms (i.e., terms having the same basic element). For example, if $F1=\{0.1|A, 0.5|B, 0.7|C\}$ and $F_2=\{0.3|a, 0.2|c\}$, then the intersection of F1 and F2 equals $\{0.1|a, 0.2|c\}$. The value of the (DPTING-ELEVATOR-i is HEAVILY-LOADED) expression is the maximum degree of membership of the terms of the fuzzy set formed by intersecting the passenger count fuzzy set and the HEAVILY-LOADED fuzzy set (e.g., 0.2 in this example), and this would be used in each rule instead of the look-up values illustrated in FIG. 10.

The real-world meaning of the up-peak onset rules is that each time any car is dispatched, it will cause a group of N rules (N is 7 in the example) to be evaluated.

In prose, an example might be:

| | |
|---|---|
| for i = 1 | 1 car left in 2 minutes but it had 10 passengers; |
| for i = 2 | 2 cars left in 2.5 minutes:<br>the first one had 10 passengers,<br>the second one had 6 passengers; |
| for i = 3 | 3 cars left in 2.9 minutes:<br>the first one had 10 passengers,<br>the second one had 6 passengers,<br>the third one had 7 passengers; |
| | . . . |
| for i = 7 | 7 cars left in 4.9 minutes:<br>the first one had 10 passengers,<br>the second one had 6 passengers,<br>the third one had 7 passengers. |

As an example, the rule corresponding to i equals three (the car that departed two cars before car 1: car 1 is the car whose departure triggered this set of rules) would be:

```
if  (DPTURE-TIME-3 is SHORT-PERIOD)
    and (3 is SEVERAL-CARS)
    and (DPTING-ELEVATOR-1 is HEAVILY-LOADED)
    and (DPTING-ELEVATOR-2 is HEAVILY-LOADED)
    and (DPTING-ELEVATOR-3 is HEAVILY-LOADED)
then set UP-PEAK
```

As described with resect to the example set forth in FIGS. 8–10 under conditions of the prose example above, this would result in a set of clauses, each clause being a conditional portion taken from FIGS. 8–10, (in the order of period, cars, load) as follows: $F(UP)_3=\{0.42, 0.81, 0.92, 0.46, 0.61\}$.

For each of the N rules, the up calculations module 152 evaluates the conditional portion of the UP-PEAK-ONSET rule since the belief that the onset of up-peak has occurred (all of the clauses of the rule being true) is no greater than the least belief of any one of them, each rule has a value of its lowest conditional. In this example, for N=3, the rule has a value of 0.42. Each rule, one for each of the last seven cars to depart, has a membership in the UP-PEAK rule set. The final value of the UP-PEAK variable equals the maximum value resulting from evaluating each of the N UP-PEAK-ONSET rules the maximum membership in the even rule set.

Figure 7:
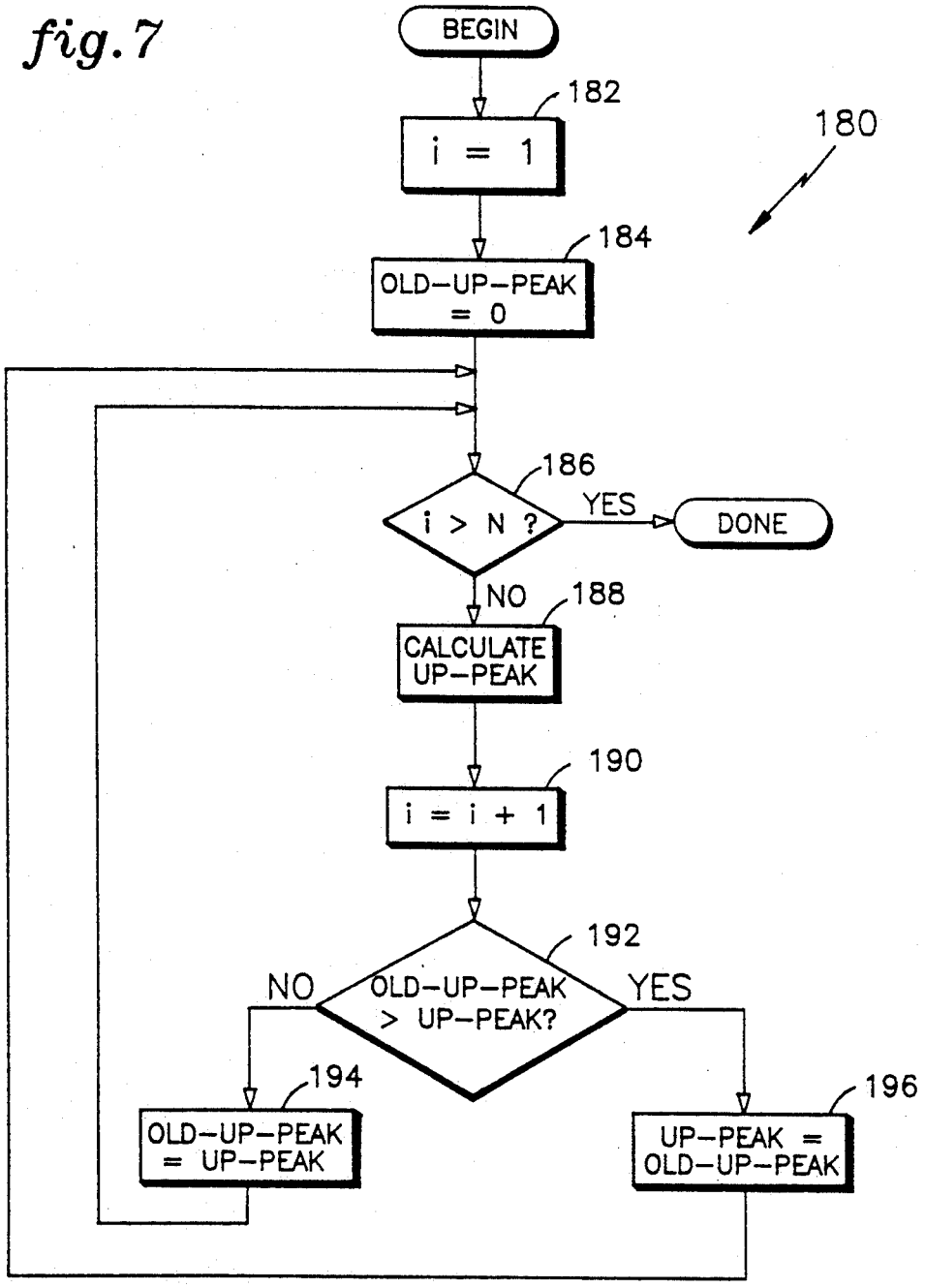
FIG. 7 is a flowchart illustrating operation of an up calculations module, according to the present invention.

Referring to FIG. 7, a flowchart 180 for evaluating the N UP-PEAK-ONSET rules shows a first step 182 where i is initialized to the value one followed by a second step 184 where a variable OLD-UP-PEAK is initialized to zero. Following the step 184 is a test step 186 where the value of i is compared to the value of N, the number of rules, If at the step 186 i is greater than N, processing is complete. Otherwise, control transfers from the step 186 to a step 188 where the UP-PEAK-ONSET rule is used to calculate a value for the membership of the ith rule in the UP-PEAK rule set. This entails looking up the FIGS. 8–10 values for ELP-TIME, DEPARTURES, and the number of passengers (or use of the result of the intersection of passengers and heavily loaded fuzzy sets referred to hereinbefore). Following the step 188 is a step 190 where the variable i is incremented.

Following the step 190 is a test step 192 where the value of OLD-UP-PEAK is compared to UP-PEAK, seeking the highest membership in the UP-PEAK rule set. If OLD-UP-PEAK is not greater than UP-PEAK, control transfers from the step 192 to a step 194, where OLD-UP-PEAK is set equal to UP-PEAK. If at the step 192 OLD-UP-PEAK is greater than UP-PEAK, control transfers from the step 192 to a step 196, where UP-PEAK is set equal to OLD-UP-PEAK. Control passes from the step 194 or the step 196 back to the step 186. The steps 192, 194, 196 ensure that the variables UP-PEAK (to be placed in the UP-PEAK data element 154, for use) and OLD-UP-PEAK (to compare with, in the next iteration) always equal the greatest value calculated for UP-PEAK at the step 188.

The UP-PEAK-TERMINATION rules used by the up calculations module 152 have the form:

```
if  (DPTURE-TIME-i is not SHORT-PERIOD)
    and (DPTING-ELEVATOR-1 is not HEAVILY-LOADED)
    and (DPTING-ELEVATOR-2 is not HEAVILY-LOADED)
    and . . .
    and (DPTING-ELEVATOR-i is not HEAVILY-LOADED)
then set OFF-UP-PEAK.
```

The up calculations module 152 processes the N UP-PEAK-TERMINATION rules in a manner similar to that illustrated in FIG. 7, using the complements of the values of FIGS. 8 and 10, or of FIG. 8 and the result of an intersection of fuzzy passengers with the fuzzy set of FIG. 10, so that OFF-UP-PEAK is the maximum value resulting from evaluating each of the N UP-PEAK-TERMINATION rules. As is well known, this complement is equal to using one minus the memberships of the up-peak data. For example, "departure time is not SHORT PERIOD", for 2 minutes, has a membership of $1-0.75=0.25$. The up calculations module 152 stores the value of the OFF-UP-PEAK variable in the off up peak data element 156.

The DOWN-PEAK-ONSET rules used by the down calculations module 162 have the form:

```
if  (ARRIVAL-TIME-i is SHORT-PERIOD)
    and (i is SEVERAL-CARS)
    and (ARVNG-ELEVATOR-1 is HEAVILY-LOADED)
    and (ARVNG-ELEVATOR-2 is HEAVILY-LOADED)
```

-continued

```
    and . . .
    and (ARVNG-ELEVATOR-i is HEAVILY-LOADED)
then set DOWN-PEAK
```

while the DOWN-PEAK-TERMINATION rules used by the down calculations module 162 have the form:

```
if  (ARRIVAL-TIME-i is not SHORT-PERIOD)
    and (ARVNG-ELEVATOR-1 is not HEAVILY-LOADED)
    and (ARVNG-ELEVATOR-2 is not HEAVILY-LOADED)
    and . . .
    and (ARVNG-ELEVATOR-i is not HEAVILY-LOADED)
then set OFF-DOWN-PEAK
```

Just as with the up calculations module 152, the down calculations module 162 processes the N DOWN-PEAK-ONSET and DOWN-PEAK-TERMINATION rules in a manner similar to and using the same inputs as that illustrated in FIG. 7 for processing the UP-PEAK-ONSET rules. The resulting values for DOWN-PEAK and OFF-DOWN-PEAK are the maximum values calculated for the N DOWN-PEAK-ONSET and DOWN-PEAK-TERMINATION rules, respectively. The down calculations module 162 stores the values of the DOWN-PEAK and OFF-DOWN-PEAK variables in the down peak data element 164 and the off down peak data element 166, respectively.

The off calculations module 170 sets the variable OFF-PEAK to the maximum of OFF-UP-PEAK (from the off up peak data element 156) and OFF-DOWN-PEAK (from the off down peak data element 166). The variable OFF-PEAK is provided by the off calculations module 170 as an output to the off peak data element 172.

The processing illustrated herein for the traffic module 56 can be done at run-time or can be done off-line, in which case a table is constructed having indices indicative of possible inputs to the traffic module 56 and having entries indicative of possible outputs of the traffic module 56. Construction and use of a similar table for the weight interpretation module 52 is shown in FIG. 5 and the discussion associated therewith. One skilled in the art could extrapolate from the specific example of FIG. 5 to build and use a similar table for the traffic module 56.

Figure 11:
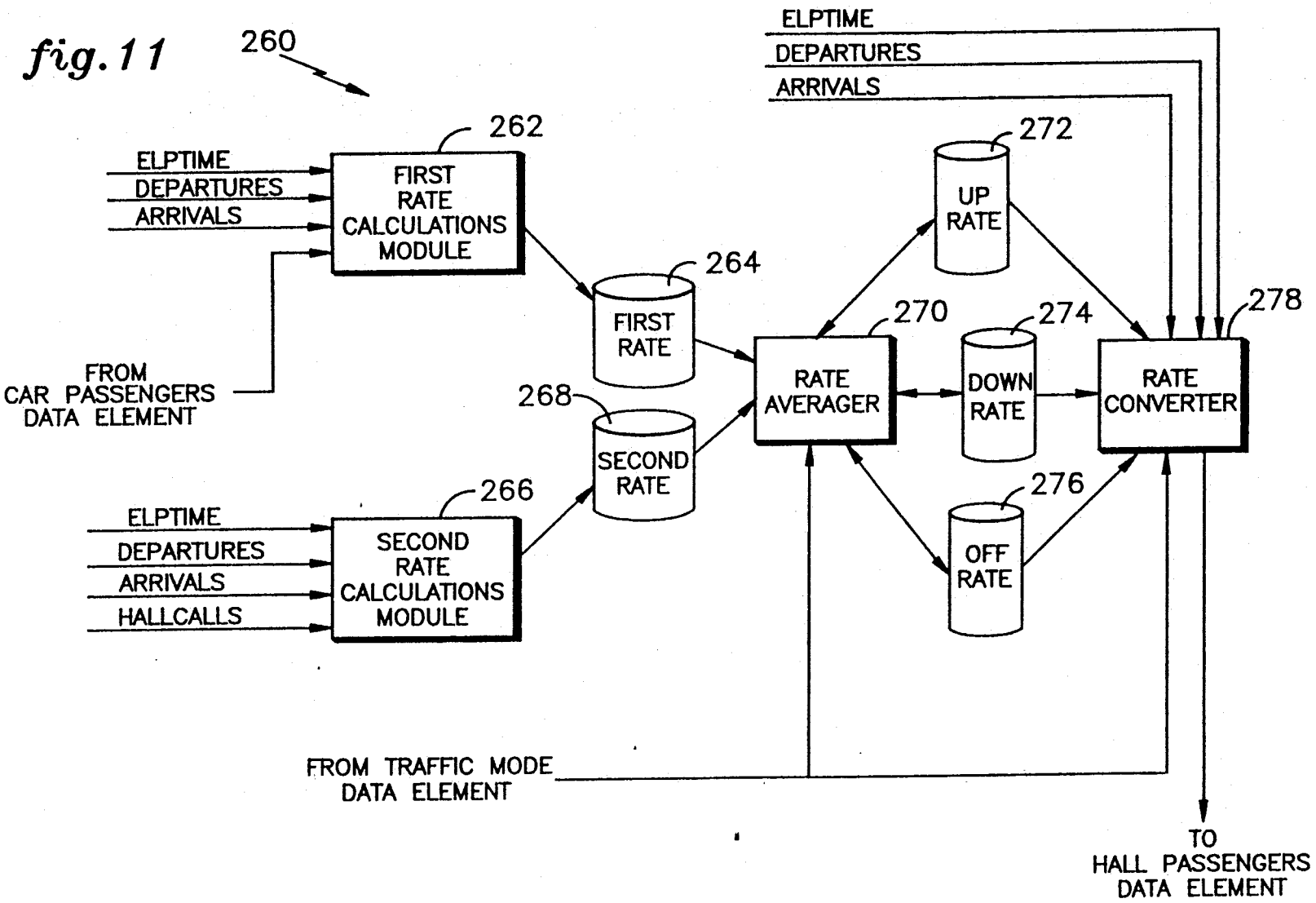
FIG. 11 is a dataflow diagram illustrating operation of a count estimator module, according to the present invention.

FIG. 11 is a dataflow diagram 260 illustrating operation of the count estimator module 60, which estimates the number of hall passengers waiting at a particular stop at a particular time. Recall that a "stop" is on a floor for one direction (up or down); there are two stops per floor except the highest and the lowest. The count estimator module 60 processes the ELPTIME, DEPARTURES, ARRIVALS, and HALLCALLS signals for each stop along with data from the car passengers data element 54 and the traffic mode data element 58 and writes the output to the hall passengers data element 62.

Referring to FIG. 11, a first rate calculations module 262 is provided with data from the car passengers data element 54 and with the ELPTIME, (time from last departure from each stop) DEPARTURES, and ARRIVALS input signals for each stop. The first rate calculator module 262 estimates the rate that hall passengers arrive at a stop to wait for an elevator car to service the stop. Calculations by the first rate module 262 (described in more detail hereinafter) are based upon an estimate of the number of passengers that enter an elevator car at a stop and the time since the stop was last serviced. The first rate calculator module 262 provides the estimated rate and information indicative of the particular stop to a first rate data element 264.

A second rate calculations module 266 is provided with input from the ELPTIME, DEPARTURES, ARRIVALS and HALLCALLS signals. The second rate calculations module 266 also estimates the rate that hall passengers arrive at a stop to wait for an elevator car to service the stop. The second rate calculations module 266 provides the estimated rate along with information indicative of the particular stop to a second rate data element 268. Calculations by the second rate module 266 (described in more detail hereinafter) are based upon the elapsed time between an elevator car servicing a particular stop and a hall passenger subsequently pressing a hall call button for that stop.

A rate averager 270 uses data from the rate data elements 264, 268 which are updated in response to requested service (car leaving a stop or hall call registered respectively) along with data from the traffic mode data element 58 to calculate an up rate which is stored in an up rate data element 272, a down rate which is stored in a down rate data element 274, and an off rate which is stored in an off rate data element 276. The up rate data element 272 contains information indicative of the up passenger rate (i.e., the rate that hall passengers arrive at the lobby to wait for an elevator car going to other floors). The down rate data element 274 contains information indicative of the rate that hall passengers arrive at other floors to wait for an elevator car going to the lobby. The off rate data element contains information indicative of the rate that hall passengers arrive to wait for elevator cars for travel between non-lobby floors.

As new rate values are calculated by the first and second rate calculations modules 262, 266 and placed in the first and second rate data elements 264, 268, respectively, the rate averager 270 updates the up, down, and off data elements 272, 274, 276 according to the current mode of the elevator system 20. If the mode is a crisp value (i.e., a single value indicative of either up, down, or off), then the rate averager 270 applies the data from the first and second rate data elements 264, 268 to only one of the appropriate up, down, or off rate data elements 272, 274, 276, respectively If, on the other hand, the traffic mode of the elevator system 20 is expressed as a fuzzy set having three terms indicative of the extent to which the system is in up, down, and off mode, the first and second rate data elements 264, 268 are applied to the up, down, or off rate data elements 272, 274, 276 in proportion to the degree of membership of terms of the traffic mode fuzzy set stored in the traffic mode data element 58.

The traffic mode data element 58 and the up, rate down, rate and off rate data elements 272, 274, 276 are provided as inputs to a rate converter module 278, which uses the input data and the ARRIVALS, DEPARTURES, and ELPTIME signals to estimate the number of hall passengers at a particular stop waiting for elevator car service. The number of hall passengers at a stop is determined by multiplying the rate (from one or more of the up, down, rate and off rate data elements 272, 274, 276, depending on the traffic mode of the system) by the amount of elapsed time since the stop was last serviced. The number of passengers is provided to the hall passengers data element 62 as a fuzzy set or a crisp value, depending on the needs of the follow on processes. Operation of the rate converter module 278 is described in more detail hereinafter.

The first rate calculations module 262 calculates a first instantaneous passenger rate, INSTRATE1, whenever an elevator car stops at a floor to answer a hall call. An assumption is made that any passengers departing from the car will do so before any hall passengers board the car. The number of passengers who board the car is therefore determined by subtracting the minimum passenger count from the final passenger count (i.e., the number of passengers in the car when the elevator doors close). The rate that is provided to the first rate data element 264, INSTRATE1, equals the number of passengers that board the car divided by the elapsed time since the particular stop was last serviced.

If the number of passengers provided by the car passengers data element 54 is a crisp value, the subtraction and division described above are straightforward. If, however, the number of car passengers is expressed as a fuzzy set, the fuzzy set describing the number of passengers when the weight is a minimum is subtracted from the fuzzy set describing the number of passengers in the car when the elevator door is closed. This subtraction is performed by subtracting every combination of basis elements and taking the minimum of the degrees of membership of the terms thus subtracted. Terms having the same basis element are combined into a single term having a degree of membership equal to the maximum degree of membership of the combined terms.

For example, assume fuzzy set F1 equals {u¦A, v¦B, w¦C} and that fuzzy set F2 equals {x¦D, y¦E, z¦F}. The fuzzy set formed by subtracting, F2 from F1 would equal:

{min(u,x)¦(A-D),min(u,y)¦(A-E),min(u.z)¦(A-F),
min(v,x)¦(B-D),min(v,y)¦(B-E).min(v,z)¦(B-F).
min(w.x)¦(C-D),min(w.y)¦(C-E),min(w.z)¦(C-F)}

Any terms having the same basis elements, for example if A-D equals C-E, are combined by taking the maximum of the degrees of membership of those terms, e.g.:

max(min(u,x), min(w,y))

As an example, if u=0.3, x=0.2, A=7, D=4; and W=0.6, y=0.4, C=4, and E=1; then combined term=max(min(0.3, 0.2), min (0.6, 0.4)¦3=0.4¦3.

As an added step for subtracting the passenger count fuzzy sets, any term of the resulting set having a basis element less than zero is eliminated since having less than zero passengers board an elevator car at a stop doesn't make sense. The first rate calculations module 262 determines INSTRATE1, the fuzzy set representing the rate of hall passenger arrivals, by dividing the basis elements of the fuzzy set resulting from subtracting the passenger count fuzzy sets by the elapsed time since the particular stop was last serviced. The resulting passenger rate fuzzy set, along with information indicative of the particular stop, is provided to the first rate data element 264.

The second rate calculations module 266 determines a second hall passenger arrival rate, INSTRATE2, whenever a hall call button is pressed. The rate fuzzy set produced by the second rate calculations module 266, INSTRATE2, assumes that the arrival of hall passengers follows a Poisson distribution. The number of hall passengers increases by only one passenger at a time. The elapsed time (T) between the last servicing of the particular stop and the pressing of the hall call button is used to construct the INSTRATE2 fuzzy set which has basis elements with values of passenger rates 1/T, 2/T, 3/T, . . . 10/T (such as one passenger per 55 seconds, two passengers per 55 seconds, etc.) wherein each term has a degree of membership defined by the formula:

$$\text{degree of membership} = RTe^{-RT}$$

where e is the natural logarithm and R is the basis element of the associated term of the fuzzy set. The degrees of membership reduce to: $e^{-1}=0.37$; $2e^{-2}=0.27$; $3e^{-3}=0.15$; . . . $10e^{-10}=0.0005$.

INSTRATE2, along with information indicative of the particular stop, is provided as an output by the second rate calculations module 266 to the second rate data element 268.

The first rate calculations module 262 updates the value of INSTRATE1, stored in the first rate data element 264, in response to an elevator car servicing a hall call. The second rate calculations module 266 updates INSTRATE2, stored in the second rate data element 268, in response to a hall passenger pressing a hall call button. The fuzzy sets which represent INSTRATE1 and INSTRATE2 are used to update fuzzy sets stored in the up rate data element 272, the down rate data element 274, and the off rate data element 276.

Prior to being used to update the values for the overall system rates stored in the up, down, and off rate data elements 272, 274, 276, an adjustment is made to the values of INSTRATE1 and INSTRATE2 to compensate for the greater probability of lower floors to have up hall calls and higher floors to have down hall calls. When a new INSTRATE1 or INSTRATE2 is calculated in response to a downward travelling elevator car or a down hall call, the basis elements of the INSTRATE1 and INSTRATE2 fuzzy sets are divided by (i=1)/(F−1) (or multiplied by the ratio of (F−1) to (i−1) where F is the total number of floors in the building and i is the particular floor that the system is servicing. Similarly, the basis elements of the INSTRATE1 and INSTRATE2 fuzzy sets are divided by (F−i)/(F−1) or multiplied by the ratio of (F−1) to (F−i) whenever a new calculation is made in response to servicing a call with an upward travelling car or an up hall call.

The rate averager 270 updates the fuzzy set stored in the up rate data element 272 whenever INSTRATE1 is updated in response to an elevator car servicing the lobby or whenever INSTRATE2 is updated in response to a lobby hall call button being pressed. The new up rate fuzzy set is a running average calculated by the following equation:

$$(0.2 \times UM \times \text{INSTRATE}) + (1.0 - (0.2 \times UM)) \times \{\text{old up rate fuzzy set}\}$$

INSTRATE in the above formula is either INSTRATE1 or INSTRATE2. UM (ul membership) is the degree of membership of the term of the traffic mode fuzzy set (from the traffic mode data element 58) which corresponds to the up traffic rate. UM ranges from zero to one.

For instance, if UM=0.2, the update will be 0.04 new INSTRATE+0.96 old INSTRATE; if UM=0.8, the update will be 0.16 new INSTRATE+0.84 old INSTRATE; term by term.

Using UM in the above equation causes the up rate fuzzy set to be affected by INSTRATE only to the extent that the elevator system is currently in the UP mode. The multiplication in the above equation affects only the degrees of membership of the terms of the fuzzy sets. The addition is performed using standard techniques, known to skilled in the art, for adding fuzzy sets. This is fully analogous to subtraction as defined hereinbefore, except that the sum of the basis elements have a combined membership equal to the max of the individual memberships, term for term; the max of like terms is also used.

The rate averager 270 updates the down rate fuzzy set and stores the new value in the down rate data element 274 whenever INSTRATE1 is updated in response to an elevator car concluding a down hall stop or whenever INSTRATE2 is updated in response to a down hall call button being pressed. The new down rate fuzzy set is calculated by the following equation:

$$(0.2\times DM\times INSTRATE)+(0.2\times DM))\times\{\text{down rate fuzzy set}\}$$

INSTRATE in the above formula is either INSTRATE1 or INSTRATE2. DM (down membership) is the degree or memberships of the term of the traffic mode fuzzy set which corresponds to the down traffic rate. DM ranges from zero to one.

The rate averager 270 updates the off rate fuzzy set and stores the new value in the off rate data element 276 whenever INSTRATE1 or INSTRATE2 is updated (in either up or down direction). The new value of off rate fuzzy set is calculated by the following equation:

$$(0.2\times OP\times INSTRATE)+(1.0-(0.2\times OP))\times\{\text{off rate fuzzy set}\}$$

INSTRATE in the above formula is either INSTRATE1 or INSTRATE2. OP (off peak) is the degree of membership of the term of the traffic mode fuzzy set which corresponds to the off peak traffic mode. OP ranges from zero to one.

The rate converter module 278 provides a fuzzy set indicative of the number of hall passengers waiting for an elevator car at any particular stop at any particular time. First, a total rate fuzzy set is constructed by combining the fuzzy set from the up rate data element 272, the fuzzy set from the down rate data element 274, and the fuzzy set from the off rate data element 276. The sets are combined by scaling the degrees of membership of each of the terms of the sets by the relative degree of membership of the corresponding terms of the traffic mode fuzzy set so that the degrees of membership of the up rate fuzzy set are scaled by UM/(UM+DM+OP), the degrees of membership of the down rate fuzzy set are scaled by DM/(UM+DM+OP), and the degrees of membership of the off rate fuzzy set are scaled by OP/(UM+DM+OP). After scaling the degrees of membership, the three sets are added together and then the values of the basis elements of the result are divided by three to produce the total rate fuzzy set.

The ELPTIME and DEPARTURE signals are used to determine the amount of time since a particular stop was last serviced. A fuzzy set indicative of the number of hall passengers waiting at a particular stop is constructed by multiplying the values of basis elements of the total rate fuzzy set by the amount of elapsed time. The resultant fuzzy set is provided by the count estimator module 60 to the hall passengers data element 62.

The processing illustrated herein for the count estimator module 60 can be done at run-time or can be done off-line, in which case a table is constructed having indices indicative of possible inputs to the count estimator module 60 and having entries indicative of possible outputs of the count estimator module 60. Construction and use of a similar table for the weight interpretation module 52 is shown in FIG. 5 and the discussion associated therewith. One skilled in the art could extrapolate from the specific example of FIG. 5 to build and use a similar table for the count estimator module 60.

There are many indicators for measuring elevator system performance, such as average wait time, wait threshold, and average service time. The average wait time is the average time between a hall call and servicing of the hall call. The wait threshold is the average number of people that wait for longer than a constant, predetermined amount of time. The average service time is the average time between a hall passenger pressing a hall call button and the same passenger arriving at the destination floor. The details of calculating the average wait time, the wait threshold, and the average service time are known to those skilled in the art. Note that elevator performance indicators can be calculated by using either crisp values or fuzzy sets.

The HALLCALLS signal is provided as an input to the performance estimator 64 which, in response to a particular hall call, uses the traffic mode and hall passengers data elements 58, 62 to construct a plurality of performance fuzzy sets. Each performance fuzzy set corresponds to a particular elevator performance indicator. Each term of each set represents the estimated value of the particular performance indicator which corresponds to servicing the hall call with a particular elevator car. The performance estimator 64 stores the fuzzy sets in the performance data element 66.

Figure 12:
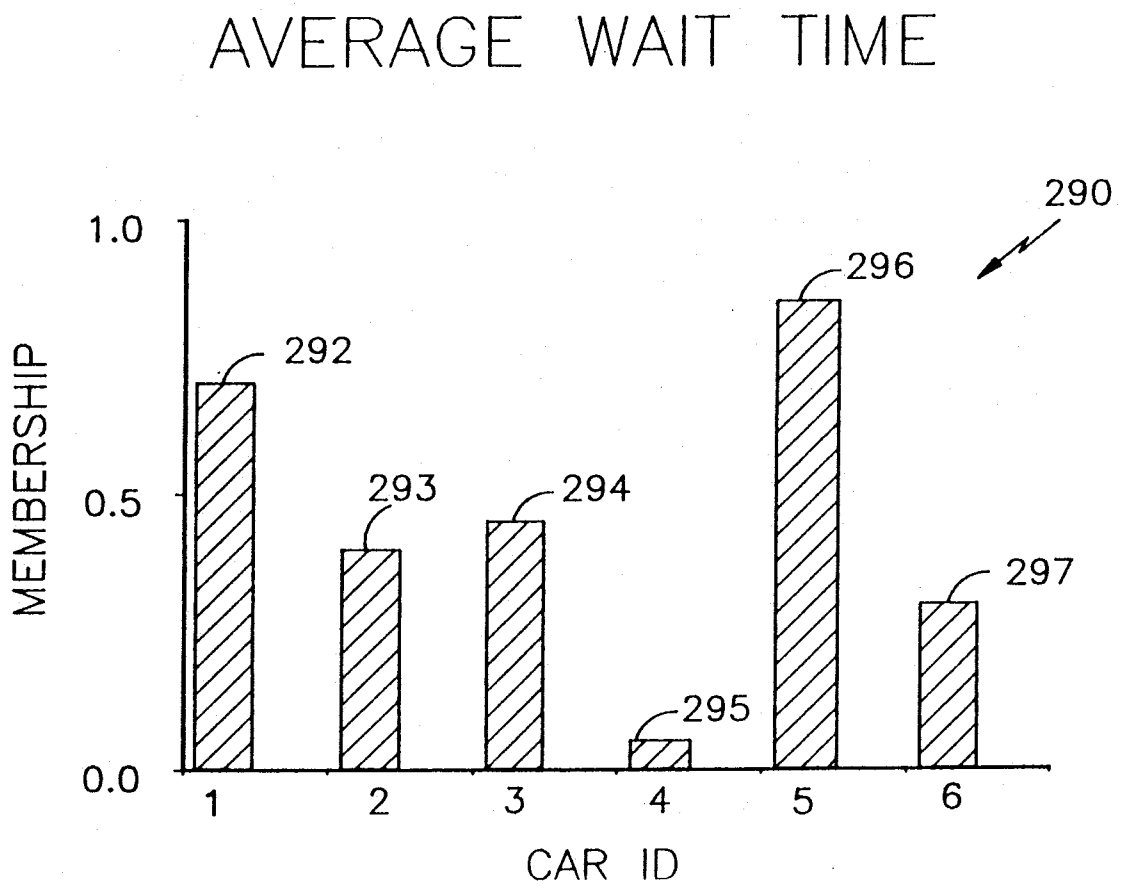
FIG. 12 is a bar chart illustrating an average wait time performance fuzzy set, according to the present invention.

Referring to FIG. 12, a graph 290 has a plurality of bars 292–297 wherein the height of each of the bars is indicative of the inverse of the estimated average wait time associated with a particular elevator car. A higher bar indicates a lower average wait time. The graph 290 can represent a performance fuzzy set wherein each basis element of the set represents a particular elevator car and the degree of membership of each basis element corresponds to the height of each of the bars 292–297. Similar fuzzy sets can be constructed for any other elevator performance indicators that can either be directly measured or derived from direct measurements. The particular indicators chosen and the method of calculation depend upon a variety of functional factors known to those skilled in the art.

Figure 13:
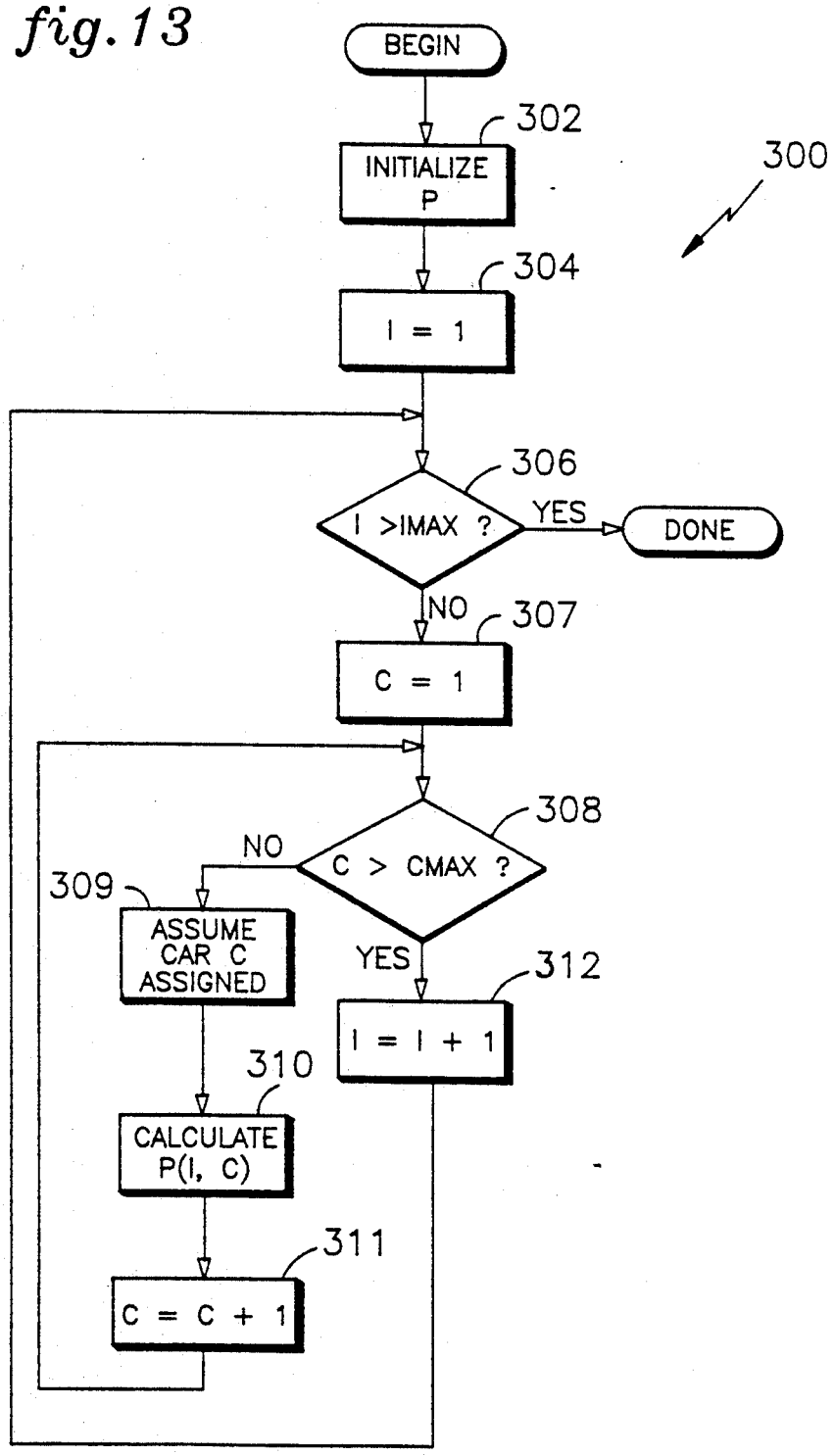
FIG. 13 is a flowchart illustrating operation of a performance estimator module, according to the present invention.

Referring to FIG. 13, a flowchart 300 illustrates steps for constructing a plurality of performance fuzzy sets such as for wait time, etc. which are represented on the flowchart 300 by the symbol P. The annotation P(I, C) indicates the Cth term, corresponding to car number equals C, of the Ith performance fuzzy set.

Figure 14:
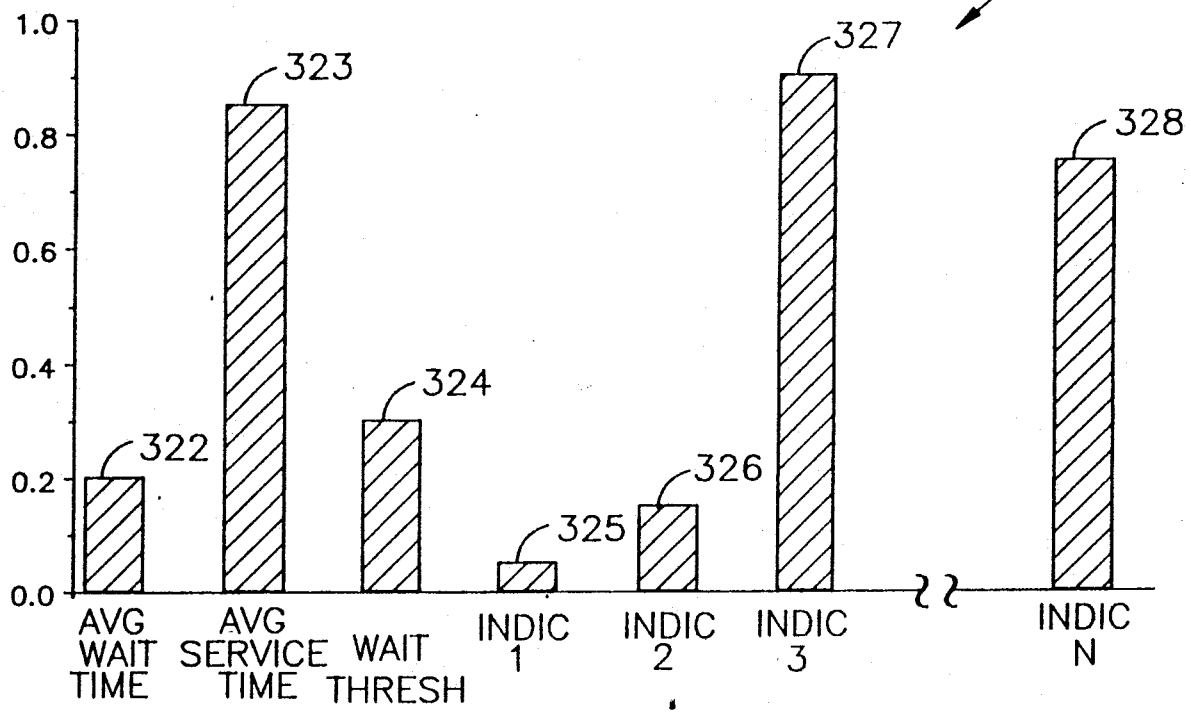
FIG. 14 is a bar chart illustrating a customer preferences fuzzy set, according to the present invention.

At a first step 302, P is initialized to contain no terms and no fuzzy sets. Following the step 302 is a step 304 where an index variable, I, for indexing into all of the performance fuzzy sets, is initialized to one. Following the step 304 is a test step 306 where I is compared to IMAX, a predetermined constant equal to the number of performance indicators (FIG. 14 shows at least seven of them).

If at the step 306 not greater than IMAX, control passes from the step 306 to a step 307 where C, an index variable for indexing through terms of the performance fuzzy sets (and hence corresponding to each of the cars), is initialized to one. Following the step 307 is a step 308 where C is compared to CMAX, the number of elevator cars in the system. If at the test step 308 C is not greater than CMAX, control passes from the step 308 to a step 309, where car C is assumed to be assigned to service a particular hall call at a particular stop and parameters related thereto are identified.

Following the step 309 is a step 310 where P(I, C), which equals the Cth term of the Ith fuzzy set, is determined. At the step 310, and the performance of the system is calculated using equations and calculation methods that are appropriate for the Ith performance indicator. The value calculated at the step 310 becomes the degree of membership of the Cth term in the Ith performance fuzzy set: e.g., call wait time for car =0.45 (FIG. 12).

After the step 310 is step 311 where the index variable C is incremented. After the step 311, control passes back to the test step 308. If at the test step 308 C is greater than CMAX, indicating that the system performance for the Ith performance indicator has been calculated for all of the cars, then control passes from the test step 308 to a step 312, where the index variable I, which indicates the particular performance criteria, is incremented. Control passes from the step 312 back to the test step 306, where I is compared to IMAX. If at the step 306 I is greater than IMAX, all of the performance fuzzy sets have been calculated and processing is complete.

Referring to FIG. 14, a customer preferences graph 320 has a plurality of bars 322–328 wherein each of the bars 322–328 corresponds to a particular elevator performance indicator and wherein the height of each of the bars 322–328 is indicative of the importance of the performance indicator to the customer. For example, the height of the bar 323, which represents average service time, is greater than the height of the bar 322, which represents the average wait time, thereby indicating that given a choice between optimizing performance using average wait time or optimizing performance using average service time, the customer prefers to use average service time.

The graph 320 can represent a customer preferences fuzzy set wherein each basis element (term) the set corresponds to a particular elevator performance indicator and wherein the height of each of the bars 322–328, which indicates the relative importance to the customer of each of the elevator performance indicators, corresponds to the degree of membership of each term of the fuzzy set. The customer preferences fuzzy set can be constructed by the elevator manufacturer or can be entered by the elevator customer (owner, operator) using a variety of data input means obvious to those skilled in the art. The customer preferences fuzzy set is stored in the customer preferences data element 68.

The performance and customer preferences data elements 66, 68 are provided as inputs to the assignment utility calculator module 70, which determines the utility (usefulness, suitability) assigning each of the cars to service a hall call and provides to the assignment utility data element 72 an assignment utility fuzzy set having basis elements corresponding to each of the elevator cars wherein the degree of membership of each basis element corresponds to the utility of assigning the associated elevator car to the particular hall call.

Figure 15:
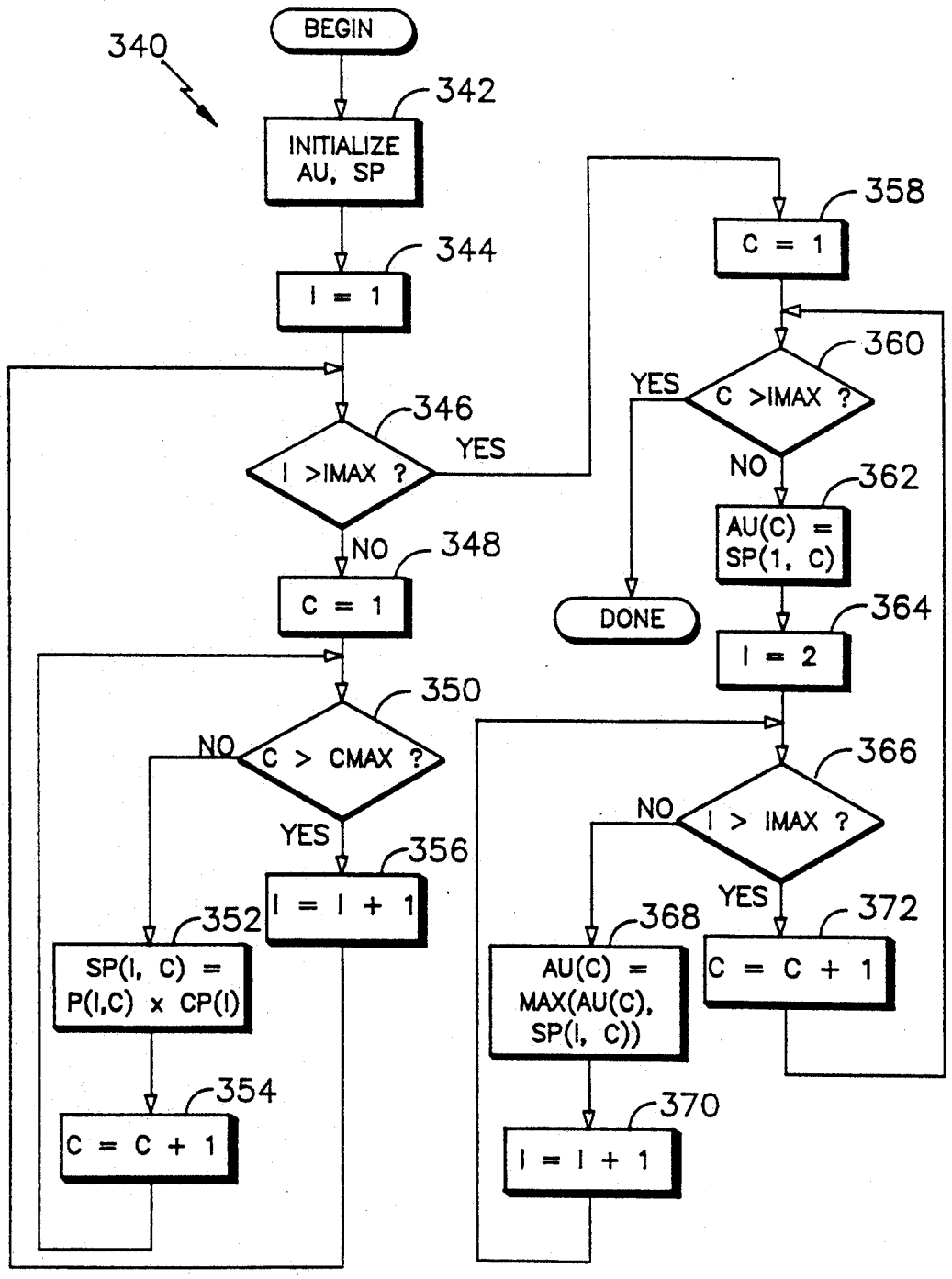
FIG. 15 is a flowchart illustrating operation of an assignment utility calculator module, according to the present invention.

For instance, if UM=0.2, the update will be 0.04 new INSTRATE+0.96 old INSTRATE; if UM=0.8, the update will be 0.16 new INSTRATE+0.84 old INSTRATE; term by term. Referring to FIG. 15, a flowchart 340 illustrates operation of the assignment utility (suitability) calculator module 70. The symbol AU indicates the assignment utility fuzzy set and the symbol SP indicates a plurality of scaled performance fuzzy sets. The symbol CP indicates the customer preferences fuzzy set. At a first step 342, the AU and SP fuzzy sets are initialized to be empty. Following the step 342 is a step 344 where an index variable I, for indexing into the performance and the scaled performance fuzzy sets, is initialized to one. Following the step 344 is a test step 346, where I is compared to IMAX, a predetermined constant equal to the number of performance fuzzy sets (i.e. the number of performance indicators, as in FIG. 14).

If at the step 346 I is not greater than IMAX, control passes from the step 346 to a step 348 where C, a variable for indexing through all of the cars of the elevator system, is set to one. Following the step 348 is a test step 350 where C is compared to CMAX, a predetermined constant equal to the number of cars in the elevator system. If at the step 350 C is not greater than CMAX, control passes from the step 350 to a step 352.

At the step 352, the degree of membership of the Cth term in the Ith scaled performance fuzzy set, SP(I-C), equal to the degree of membership of the Cth term of the Ith performance fuzzy set, P(I,C), times the degree of membership of the Ith term of the customer preferences fuzzy set, CP(I). If CP(I) is close to one, indicating that the Ith performance indicator is important to the customer, the degree of membership of the Cth term of the Ith scaled performance fuzzy set will nearly equal the Ct term of the Ith performance fuzzy set. If, on the other hand, CP(I) is at or near zero, indicating that the Ith performance indicator is not important to the customer, then the Cth term of the Ith scaled performance fuzzy set will equal or be close to zero, irrespective of the value of the Cth term of the Ith performance fuzzy set.

After the step 352 is a step 354 where the variable C is incremented. After the step 354, control passes back to the test step 350 where C is compared to CMAX. If at the step 350 C is greater than CMAX, indicating that all of the terms of the Ith scaled performance fuzzy set have been calculated, control passes from the step 350 to a step 356 where I, the variable used for indexing through the performance indicators, is incremented. After the step 356, control passes back to the test step 346, where I is compared to IMAX, the number of performance indicators. This is fully analogous to subtraction as defined hereinbefore, except that the sum of the basis elements have a combined membership equal to the max of the individual memberships, term for term; the max of like terms is also used.

If at the test step 346 I is greater than IMAX, control passes from the test step 346 to a step 358, where the index variable C is initialized to one. After the step 358 is a test step 360, where C is compared to CMAX, the number of elevator cars. If at the step 360 C is not greater than CMAX, control passes to a step 362, where the degree of membership of the Cth term of the assignment utility fuzzy set AU(C), is set equal to the Cth term (car 1, initially) of the first scaled performance fuzzy set, SPC(I,C). After the step 362 is a step 364, where the variable I, for indexing of the scaled performance fuzzy sets is set to two, so that the term in the second scaled performance fuzzy set for this car can be compared with the term for this car in the first scaled performance fuzzy set (SP(1,2) vs. SP(2,3)).

After the step 364 is a test step 366 where C is compared to IMAX, the number of performance indicators (and fuzzy sets) in the system. If I is not greater than IMAX, control passes to a step 368, where the Cth term, (car=C) of the assignment utility fuzzy set is set equal to the greater of the Cth term of the Ith (initially, the second) scaled performance fuzzy set and the previous value of the Cth term of the assignment utility fuzzy set. The step 368 ensures that the Cth term of the assignment utility fuzzy set always equals the maximum value of the Cth terms of all of the scaled performance fuzzy sets.

Following the step 368 is a step 370 where the variable I is incremented. After the step 370, control passes back to the test step 366. If at the step 366 I is greater than IMAX, control passes from the step 366 to a step 372 where C, the index variable for the cars, is incremented. After the step 372, control passes back to the test step 360 where, if C is greater than CMAX, processing is complete. The resulting assignment utility fuzzy set is provided as an output to the assignment utility data element 72.

The processing illustrated herein for the performance estimator module 64 and the assignment utility module 70 can be done at run-time or can be done off-line, in which case a table is constructed having indices indicative of possible inputs to the performance estimator module 64 and the assignment utility module 70 and having entries indicative of possible outputs of the performance estimator module 64 and the assignment utility module 70. Construction and use of a similar table for the weight interpretation module 52 is shown in FIG. 5 and the discussion associated therewith. One skilled in the art could extrapolate from the specific example of FIG. 5 to build and use a similar table for the performance estimator module 64 and the assignment utility module 70.

The assignment utility data element 72 is provided as an input to the uncertainty filter module 74, which determines the final, tentative elevator car assignment (a crisp value) by choosing the car corresponding to the term of the assignment utility fuzzy set having the highest degree of membership. The uncertainty filter module 74 will only provide an assignment to the assignment data element 76 when the uncertainty of the assignment is below a predetermined value that is stored in the customer preferences data element 68 which is provided as an input to the uncertainty filter module 74. The uncertainty of an assignment can be expressed in terms of certainty, which is defined as the degree of membership of the term having the highest degree of membership (the term of the tentatively assigned car) divided by the sum of the degrees of membership of all of the terms of the assignment utility fuzzy set. A customer that prefers a relatively quick assignment of a car to a hall call would specify a high degree of uncertainty (where the highest degree of membership is not much higher than the rest) while a customer who does not care about a quick assignment would specify a low degree of uncertainty (where highest degree of membership really stands out).

Alternatively, the uncertainty filter module 74 may provide an assignment to the assignment data element 76 after a constant predetermined amount of time which is stored in the customer preferences data element 68. The value of the assignment will be the car represented by the basis element (car identity) in utility fuzzy set, (AU(C), having the highest degree or membership (inverse uncertainty) therewith.

As a third alternative, the uncertainty filter module 74 may adjust the uncertainty threshold as a function of the elapsed time since the hall call button was pressed. As the elapsed time increases, the threshold decreases. The threshold vs. time function, can be linear or nonlinear, depending on the requirements of the particular elevator system. Or, the threshold can be a minimum value which the degree of membership of the selected car must have before it is assigned—either a fixed threshold or one that decreases with elapsed time from the hall call.

The processing illustrated herein for the uncertainty filter module 74 can be done at run-time or can be done off-line, in which case a table is constructed having indices indicative of possible inputs to the uncertainty filter module 74 and having entries indicative of possible outputs of the uncertainty filter module 74. Construction and use of a similar table for the weight interpretation module 52 is shown in FIG. 5 and the discussion associated therewith. One skilled in the art could extrapolate from the specific example of FIG. 5 to build and use a similar table for the uncertainty filter module 74.

The invention illustrated herein is applicable to any elevator system having any number of cars, stopping on any number of floors, having any maximum capacity, maximum velocity, or having any other specific set of physical characteristics. Similarly, the invention may be practiced irrespective of the physical design of the elevator system, including drives, counterweights, cabling, door mechanisms, hall call and car call signaling devices.

Although the invention has been shown in an elevator system having a single lobby floor on the lowest floor of the building, the invention may be practiced irrespective of whether the elevator system has more than one lobby floor and whether or not the lobby floor is the lowest floor in the building.

Furthermore, the invention may be practiced irrespective of the processes used to carry out other elevator dispatching functions, the specific electronic hardware used to implement the invention, or the design of the load weighing device. Portions of the processing illustrated herein may be implemented with electronic hardware, which would be straightforward in view of the hardware/software equivalence discussed (in another field) in U.S. Pat. No. 4,294,162 entitled "Force Feel Actuator Fault Detection with Directional Threshold" (Fowler et al.). Instead of reading and writing data to and from data elements, the hardware would communicate by receiving and sending electronic signals.

Although only run-time operation of the traffic module 56, the count estimator module 60, the performance estimator module 64, the assignment utility calculator module 70 and the uncertainty filter module 74 is illustrated herein, the modules 56, 60, 64, 70, 74 may be run off-line to generate lookup tables containing all of the possible inputs and the resulting outputs. Off-line generation and use of a lookup table is illustrated for the weight interpretation module 52 in FIG. 5 and the text relating thereto.

Many of the modules which use fuzzy values for input may be adapted, in a manner obvious to one skilled in the art, to use crisp inputs. In fact, the utility (suitability) of assigning each car, expressed as the corresponding term of AU(C), is crisp, just as is the case for any other car to call evaluation from which a winning car is selected for assignment to a call. The performance estimator module 64 and the customer preferences data element 68 may be adapted to use any type of elevator performance criteria. The invention may be practiced irrespective of the mechanism used to set or change the customer preferences.

Although the invention has been shown and described with respect to exemplary embodiments thereof, it should be understood by those skilled in the art that various changes, omissions and additions may be made therein and thereto, without departing from the spirit and the scope of the invention.

What is claimed is:

1. A method of dispatching elevator cars in a building having a plurality of elevator cars, in response to each registered hall call, comprising:

for each car that is a candidate to respond to the hall call, providing a signal indicative of a term in each one of a plurality of sets of criteria signals, each set corresponding to a related hall call assignment performance criterion, each term having a value related to the degree to which the corresponding car is suitable for assignment to said call with respect to the related performance criterion;

providing a predetermined set of preference signals, each representing a value indicative of the degree to which a corresponding one of said criteria is deemed important in assigning cars to respond to hall calls;

providing a plurality of scaled performance sets of signals by multiplying the signals in each of said criteria sets by the corresponding one of said preference signals;

selecting for each car the term related to such car, from among all of said scaled performance sets, which has the maximum value; and dispatching the one of said cars having the largest one of said maximum value terms to respond to said hall call.

2. A method according to claim 1 wherein at least one of said criteria is expressed in terms inverse to its effect on the suitability of a car to respond to a hall call.

* * * * *